US010161699B2

(12) United States Patent
Sessions et al.

(10) Patent No.: US 10,161,699 B2
(45) Date of Patent: Dec. 25, 2018

(54) TAKEDOWN FIREARM WITH INTEGRAL FOREND STORAGE

(71) Applicant: Magpul Industries Corp., Austin, TX (US)

(72) Inventors: Turner Sessions, Lafayette, CO (US); Grady Barfoot, Denver, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 15/824,672

(22) Filed: Nov. 28, 2017

(65) Prior Publication Data

US 2018/0156555 A1 Jun. 7, 2018

Related U.S. Application Data

(60) Provisional application No. 62/430,247, filed on Dec. 5, 2016.

(51) Int. Cl.

| | |
|---|---|
| ***F41A 11/04*** | (2006.01) |
| ***F41C 23/22*** | (2006.01) |
| ***F41A 11/00*** | (2006.01) |

(52) U.S. Cl.

CPC ..... *F41A 11/04* (2013.01); *F41A 11/00* (2013.01); *F41C 23/22* (2013.01)

(58) Field of Classification Search

CPC ..... F41A 11/02; F41A 11/04; F41A 11/00; F41C 23/00; F41C 23/12; F41C 23/22; F41C 23/04; F41C 23/16; F41C 23/14

See application file for complete search history.

(56) References Cited

U.S. PATENT DOCUMENTS 521,202 A * 6/1894 Burgess ..... F41C 23/16 42/71.01
570,145 A * 10/1896 Pittavino ..... F41C 23/04 42/72
652,583 A * 6/1900 Baird ..... F41C 7/11 42/71.01

(Continued)

FOREIGN PATENT DOCUMENTS

DE 102009051416 A1 7/2010
EP 0216015 A1 4/1987

(Continued)

OTHER PUBLICATIONS

Eger, Chris, "4 Foldable Submachine Guns", Retrieved from http://www.guns.com/2013/02/08/foldable-submachine-guns/, Feb. 8, 2013, p. 9.

(Continued)

*Primary Examiner* — Derrick R Morgan
(74) *Attorney, Agent, or Firm* — Neugeboren O'Dowd PC

(57) ABSTRACT

A stock assembly for a takedown firearm and related methods are disclosed. The stock assembly has a buttstock assembly, and a forend assembly removably couplable to the buttstock assembly at a first location and a second location. When the forend assembly is coupled to the buttstock at the first location, the forend assembly is positioned to support a barrel of the firearm in a longitudinal firing position. When the forend assembly is coupled to the buttstock at the second location, the forend assembly is positioned to support the barrel at an angle relative to the longitudinal firing position.

17 Claims, 23 Drawing Sheets

(56) References Cited

U.S. PATENT DOCUMENTS

| | | | | |
|---|---|---|---|---|
| 711,989 | A | 10/1902 | Marble | |
| 856,016 | A | 6/1907 | Balson | |
| 894,101 | A | 7/1908 | Balson | |
| 931,328 | A * | 8/1909 | Marble | F41C 23/04 42/72 |
| 1,083,384 | A | 1/1914 | Browning | |
| 1,150,763 | A * | 8/1915 | High | F41C 23/04 42/72 |
| 1,370,118 | A | 3/1921 | Johnson | |
| 1,517,420 | A | 12/1924 | Lewis | |
| 1,779,770 | A * | 10/1930 | Harrington | F41A 11/04 42/40 |
| 2,298,678 | A | 10/1942 | Chase | |
| 2,345,083 | A | 3/1944 | Williams | |
| 2,476,355 | A | 7/1949 | Brown | |
| 2,495,977 | A | 1/1950 | Madsen | |
| 2,852,880 | A * | 9/1958 | Kauffman | F41A 11/00 42/106 |
| 3,267,600 | A * | 8/1966 | Ryan | F41C 3/06 124/2 |
| 3,618,248 | A | 11/1971 | Into et al. | |
| 3,618,249 | A * | 11/1971 | Grandy | F41C 23/04 42/72 |
| 3,638,344 | A | 2/1972 | Wagner et al. | |
| 3,641,694 | A * | 2/1972 | Seidel | F41A 19/33 42/72 |
| 4,299,046 | A * | 11/1981 | Atchisson | F41A 9/72 42/40 |
| 4,625,621 | A * | 12/1986 | Warin | F41C 9/02 42/1.09 |
| 5,048,213 | A | 9/1991 | Gerhard | |
| 5,225,613 | A | 7/1993 | Claridge | |
| 5,924,233 | A * | 7/1999 | Strobel | F41C 23/12 42/72 |
| 5,933,998 | A | 8/1999 | Plebani | |
| 5,987,797 | A | 11/1999 | Dustin | |
| 6,470,617 | B1 * | 10/2002 | Gregory | F41C 7/11 42/75.02 |
| 6,539,659 | B2 | 4/2003 | Salva | |
| 6,874,266 | B1 | 4/2005 | Kong | |
| 6,889,463 | B2 * | 5/2005 | Orth | F41A 21/484 42/75.01 |
| 7,104,000 | B2 * | 9/2006 | Orth | F41A 11/04 42/71.01 |
| 7,503,137 | B2 | 3/2009 | Filicietti | |
| 7,644,528 | B2 | 1/2010 | Wossner et al. | |
| 7,805,873 | B2 | 10/2010 | Bentley | |
| 7,841,121 | B1 * | 11/2010 | Barrett | F41A 11/04 42/75.02 |
| 7,861,451 | B1 | 1/2011 | Moody et al. | |
| 7,937,873 | B2 | 5/2011 | Keng | |
| 8,069,600 | B2 | 12/2011 | Rousseau et al. | |
| 8,079,169 | B2 | 12/2011 | Gregg | |
| 8,312,661 | B2 * | 11/2012 | Ludlow | F41C 23/04 42/73 |
| D681,148 | S | 4/2013 | Wilkinson | |
| 8,689,478 | B2 | 4/2014 | Patel | |
| 8,782,941 | B2 | 7/2014 | Zusman | |
| 8,943,728 | B2 | 2/2015 | Ward et al. | |
| 9,021,734 | B2 * | 5/2015 | Voigt | F41A 11/04 42/75.04 |
| 9,188,399 | B1 * | 11/2015 | Findlay | F41A 3/66 |
| 2009/0277066 | A1 * | 11/2009 | Burt | F41A 3/66 42/6 |
| 2010/0281742 | A1 * | 11/2010 | Barrett | F41A 11/04 42/75.02 |
| 2011/0099872 | A1 | 5/2011 | Bentley et al. | |
| 2013/0212920 | A1 * | 8/2013 | Law | F41C 23/14 42/75.03 |
| 2014/0075802 | A1 * | 3/2014 | Dubois | F41A 11/00 42/16 |
| 2014/0352190 | A1 * | 12/2014 | Voigt | F41C 23/14 42/73 |
| 2015/0184957 | A1 * | 7/2015 | Guerini | F41A 3/06 42/40 |
| 2016/0084612 | A1 * | 3/2016 | Robinson | F41C 23/04 42/73 |
| 2016/0377361 | A1 * | 12/2016 | Osborne | F41A 9/17 42/11 |
| 2017/0205186 | A1 * | 7/2017 | Kjellberg | F41C 9/02 |
| 2018/0017346 | A1 * | 1/2018 | Jones | F41A 3/66 |
| 2018/0058802 | A1 * | 3/2018 | Hall | F41C 7/11 |
| 2018/0224233 | A1 * | 8/2018 | Macy | F41A 19/12 |
| 2018/0231348 | A1 * | 8/2018 | Whelan | F41C 23/22 |

FOREIGN PATENT DOCUMENTS

| | | | |
|---|---|---|---|
| EP | 0862040 | A2 | 9/1998 |
| GB | 298964 | A | 10/1928 |
| WO | 2001022023 | A1 | 3/2001 |
| WO | 2008097308 | A2 | 8/2008 |

OTHER PUBLICATIONS

Adaptive Tactical, "ADTAC RM4 Rear Stock", Retrieved from https://adaptivetactical.com/products/adtac-rm4-replacement-ras, Known to exist as early as Sep. 26, 2016, p. 2.

Henry Repeating Arms, "U.S. Survival AR-7", Retrieved from https://www.henryusa.com/rifles/u-s-survival-ar-7/, Known to exist as early as Feb. 9, 2016, p. 5.

Cheaper Than Dirt!, "Ruger Stock", Retrieved from http://blog.cheaperthandirt.com/wp-content/uploads/2013/01/IMG_93661.jpg, Known to exist as early as Sep. 22, 2016, p. 1.

Chiappa Firearms, "Chiappa M6 Folding Shotgun/Rifle", Retrieved from https://www.chiappafirearms.com/p.php?id=213, Known to exist as early as Feb. 9, 2016, p. 21.

Kel Tec Weapons. "The SU-22 Series" Retrieved from https://www.keltecweapons.com/rifles/su-22ca, Known to exist as early as Sep. 22, 2016, p. 2.

Kel Tec, "SU16", Retrieved from http://siarsenal.com/wp-content/uploads/2015/11/KelTecSU16_2.jpg, Known to exist as early as Sep. 22, 2016, p. 1.

Kel Tec Weapons, "The Sub-2000", Retrieved from https://www.keltecweapons.com/rifles/sub-2000, Known to exist as early as Feb. 9, 2016, p. 3.

Magpul Industries, Inc., "Magpul FMG9 (Folding Machine Gun) Featured on Discovery Channel's Ultimate Weapons", Retrieved from https://www.youtube.com/watch?v=pY2EqFzPzn8, Aug. 26, 2009, p. 8.

Marlin Firearms, "Model 70PSS (Take Down)", Retrieved from https://www.marlinfirearms.com/rimfire/model-795/model-70pss-take-down, Known to exist as early as Feb. 9, 2016, p. 2.

Nemesis Arms, Inc., "Vanquish Multi-Caliber", Retrieved from http://www.nemesisarms.com/nemesis_vanquish.html, Known to exist as early as Feb. 9, 2016, p. 1.

guns.com, "Remington Model 8: Brownings Semi-Auto Sporting Rifle", Retrieved from http://www.guns.com/2015/09/30/remington-model-8-browning-semi-automatic-sporting-rifle/, Known to exist as early as Feb. 9, 2016, p. 5.

User FF162162BFD, "RGUNS SMS Stock", Retrieved from http://photobucket.com/gallery/user/ff162162bfd/media/cGF0aDovUkdVTIMtU01TLVN0b2NrLmpwZw==/?ref=, Known to exist as early as Sep. 22, 2016, p. 3.

Church, A.K., "Springfield Armory M-6 Scout Survival Gun", Retrieved from http://www.milesfortis.us/church/akc13.htm, Aug. 6, 2003, p. 15.

The Arms Room, LLC, "Achieve Tactical Superiority", Retrieved from http://www.thearmsroom.com/id3.html, Known to exist as early as Feb. 9, 2016, p. 3.

* cited by examiner

TAKEDOWN FIREARM WITH INTEGRAL FOREND STORAGE

CLAIM OF PRIORITY UNDER 35 U.S.C § 119

The present application for patent claims priority to Provisional Application No. 62/430,247 entitled "Takedown Firearm with Integral Forend Storage" filed Dec. 5, 2016, and assigned to the assignee hereof and hereby expressly incorporated by reference herein.

FIELD OF THE DISCLOSURE

The present disclosure relates generally to firearms. In particular, but not by way of limitation, the present disclosure relates to systems, methods and apparatuses for a breakdown rifle.

DESCRIPTION OF RELATED ART

Handguns have long been the weapon of choice when space is at a minimum. However, handguns do not compare in accuracy and ease of long range shooting to rifles and carbines. Over the years, many have devised various breakdown rifles and carbines that can be stowed in backpacks or small carrying cases. For instance, the M4 Survival Rifle, M6 Aircrew Survival Weapon, ArmaLite AR-7, Kel-Tec SUB-2000, and Kel-Tec SU-16 are just a few examples of breakdown rifles/carbines that have been developed. However, each of these have their disadvantages. For instance, another example breakdown rifle, the Marlin Model 70PSS Stainless Papoose Rifle, lacks a forend or handguard, making it less suitable for high precision applications due to inconsistent barrel harmonics and less comfortable for use during long strings of fire such as during training due to heat. This issue is exacerbated as caliber size increases since larger rounds transfer more heat to the barrel. Additionally, grasping a barrel directly can affect barrel harmonics and potentially reduce accuracy. As another example, folding breakdown firearms (e.g., the Kel-Tec SUB-2000 and Kel-Tec SU-16) typically fold at an axis near a rear of the receiver and consequently leave the muzzle of the firearm exposed and susceptible to damage, especially if carried in a backpack or other non-traditional carrying case. Although a shorter barrel (e.g., under 16") on some of these firearms would help reduce exposure of the muzzle to damage, shortening the barrel length too much can change a firearm's federal classification (e.g., Title Iv. Title II), thus increasing its cost and licensing requirements. Companies wishing to maintain mass market appeal of their firearms therefore typically avoid barrel lengths under 16". It is true that some "covert" folding firearms such as the MAGPUL FMG-9, protect the muzzle in the stowed configuration, however, they tend to have very short barrels (which introduces the Title II downsides discussed above), and are thus better suited to close quarters firing than for medium to long range accuracy. Others, like the Ruger SR-556 Takedown, or Remington/Bushmaster ACR are stored in separate pieces, making stowage and transport more complicated than folding-style weapons. Some, such as the US Survival Rifle variation of the AR-7, stow multiple pieces of the firearm in the stock, and while this protects the components and provides a single small package for carry, it also requires that the firearm be separated into a greater number of pieces to facilitate such compact storage. Further, many of these designs are limited to .22 caliber or smaller caliber rimfire firearms. What is more, most of these breakdown weapons are custom designs and thus their features and function are specific to that individual design and are not easily implemented across a broad range of weapons.

Many of these breakdown weapons also attempt to use space in the stock to store extra ammunition or magazines. However, these attempts typically leave the ammunition or magazines at least partially exposed and those prone to impact and moisture (e.g., Kel-Tec SU-16 and the ADTAK RM-4). Others arrange magazines or cartridges longitudinally through a rear of the buttstock, but this means that only a single magazine or cartridge can be accessed at a time, and a complex reshuffling is required to use a second or third magazine or cartridge.

SUMMARY

An exemplary stock assembly for a takedown firearm has a buttstock assembly, and a forend assembly removably couplable to the buttstock assembly at a first location and a second location. When the forend assembly is coupled to the buttstock at the first location, the forend assembly is positioned to support a barrel of the firearm in a longitudinal firing position. When the forend assembly is coupled to the buttstock at the second location, the forend assembly is positioned to support the barrel at an angle relative to the longitudinal firing position.

An exemplary takedown firearm has a stock assembly having (a) a buttstock assembly; and (b) a forend assembly removably couplable to the buttstock assembly at a first location and a second location; wherein when the forend assembly is coupled to the buttstock at the first location, the forend assembly is positioned to support a barrel of the firearm in a longitudinal firing position; and when the forend assembly is coupled to the buttstock at the second location, the forend assembly is positioned to support the barrel at an angle relative to the longitudinal firing position. The exemplary assembly also has a barrel removably coupled to the forend, the barrel having a barrel shank, the barrel shank configured to engage an aperture in the buttstock assembly when the forend assembly is coupled to the buttstock at the second location.

An exemplary method includes providing a stock assembly for a takedown firearm, the stock assembly having: a buttstock assembly, and a forend assembly removably couplable to the buttstock assembly at a first location and a second location. The exemplary method also includes coupling the forend assembly to the buttstock at the first location, wherein the forend assembly is positioned to support a barrel of the firearm in a longitudinal firing position. The exemplary method also includes coupling the forend assembly to the buttstock at the second location, wherein the forend assembly is positioned to support the barrel at an angle relative to the longitudinal firing position.

DETAILED DESCRIPTION

Figure 1:
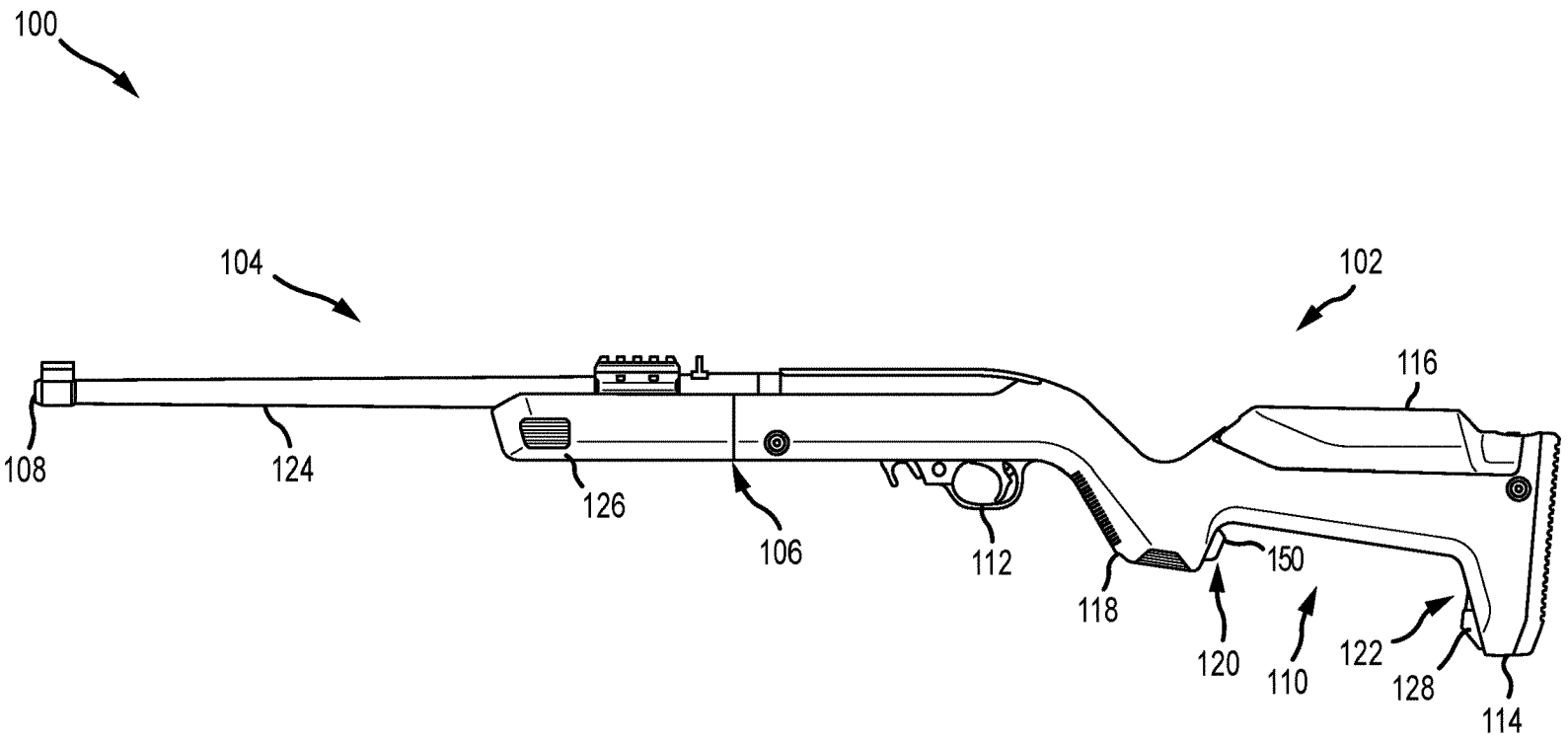
FIG. 1 is a side view of a takedown firearm and stock assembly in a deployed configuration.

To overcome the challenges of breakdown rifles/carbines in the prior art, the present disclosure presents a breakdown or "backpacker" rifle comprising a stock assembly 102 and a forend assembly 104. The illustrated firearm 100 can be fired when in a deployed configuration (see FIG. 1), can be separated at a forend-to-stock interface 106, and the forend assembly 104 can be releasably coupled to an underside of the stock assembly 102 to ease carrying of the firearm 100 and protect a muzzle 108 when the firearm 100 is in a stowed configuration (see FIGS. 2-4).

The stock assembly 102 can include a forend assembly storage cavity 110 (compare FIG. 1 and FIG. 2), an action assembly 112, a buttstock 114, a cheek piece 116, and a tang 118. The forend assembly storage cavity 110 can include a fore region 120 and an aft region 122, and can be arranged between the buttstock 114 and the tang 118 and below the cheek piece 116, as illustrated in FIG. 2.

Figure 2:
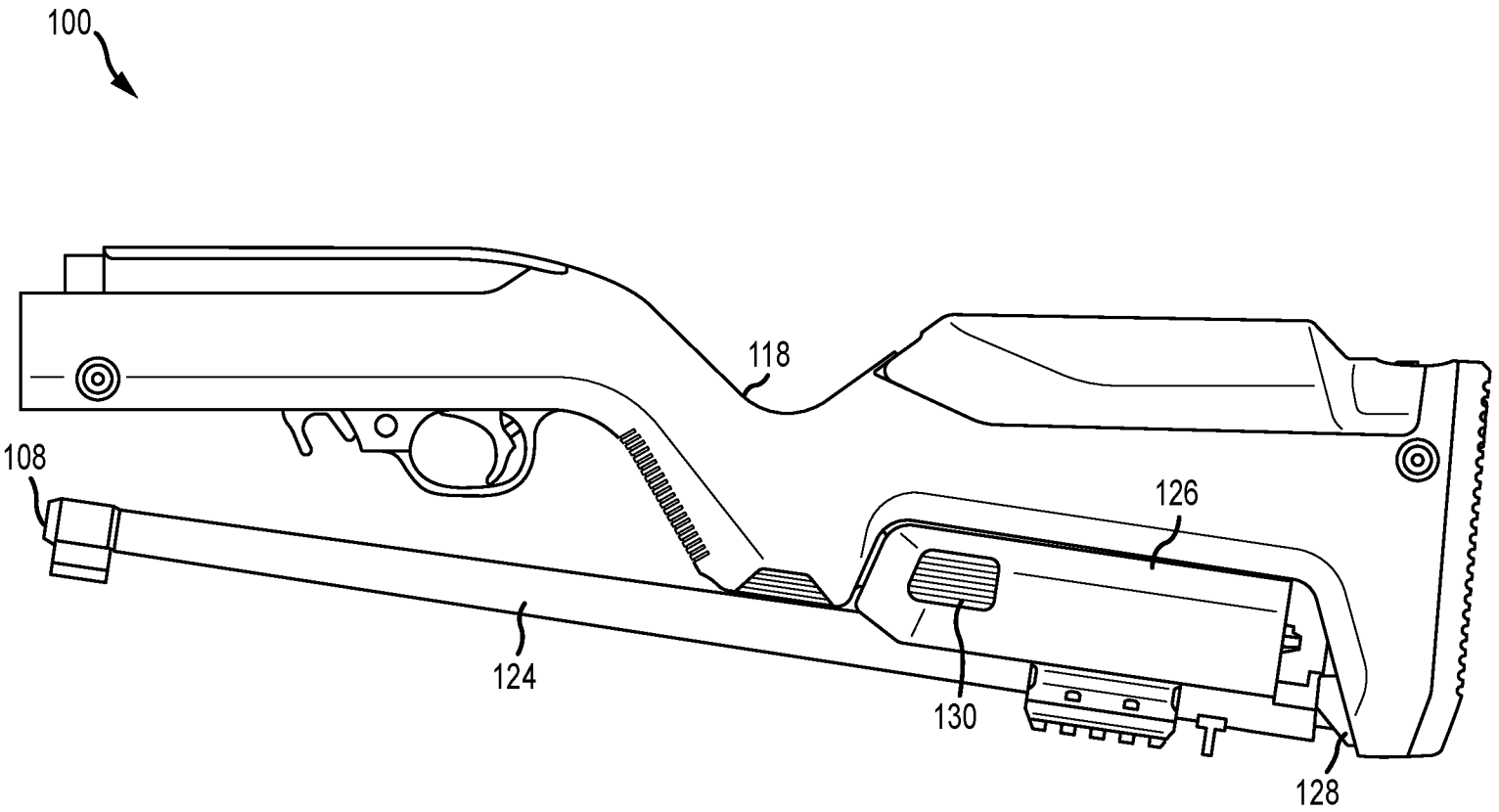
FIG. 2 is a side view of the assembly in FIG. 1 in a storage configuration.
Figure 16:
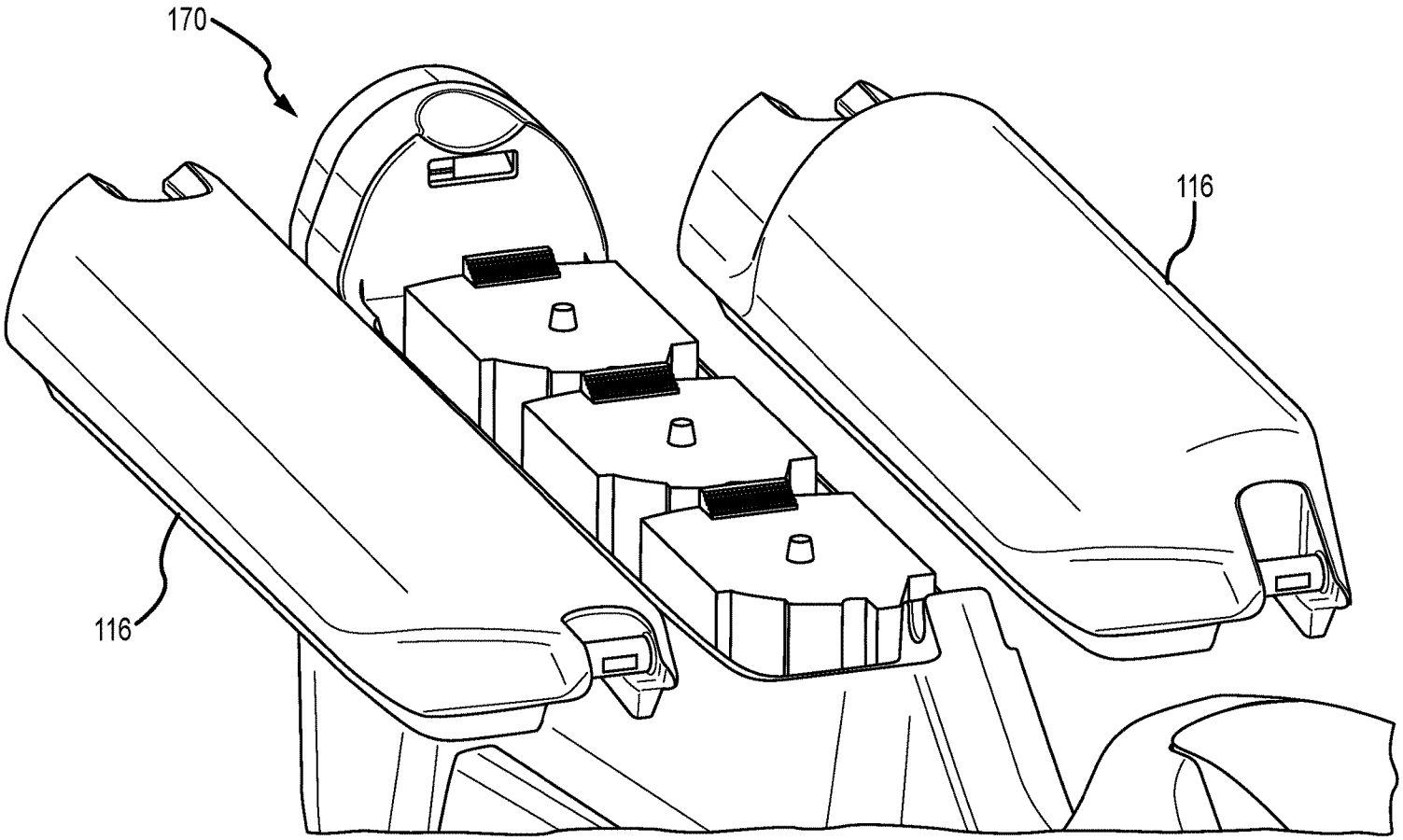
FIG. 16 is a view of a storage compartment with multiple cheekpieces suitable for use with the assembly in FIG. 1.

There may be a plurality of variations of the cheek piece 116, a first illustrated in FIG. 1, and two variations visible in FIG. 16.

The action assembly 112 may be removable from the stock assembly 102, and can include a trigger assembly, receiver, and bolt among other components. The action assembly 112 may be configured for use with .22 caliber rimfire rounds, although other calibers and round types can also be implemented with the stock assembly 102. The cheek piece 116 may provide a protective and optionally sealed (e.g., water tight) covering for a stock storage compartment 170 (not visible in FIGS. 1-4, but see FIGS. 16-17).

The forend assembly storage cavity 110 can be shaped to accept a forend 126 of the forend assembly 104 when the firearm 100 is in the stowed configuration. The forend 126 can be defined as a structure under the barrel and forward of the stock assembly 102.

Figure 5:
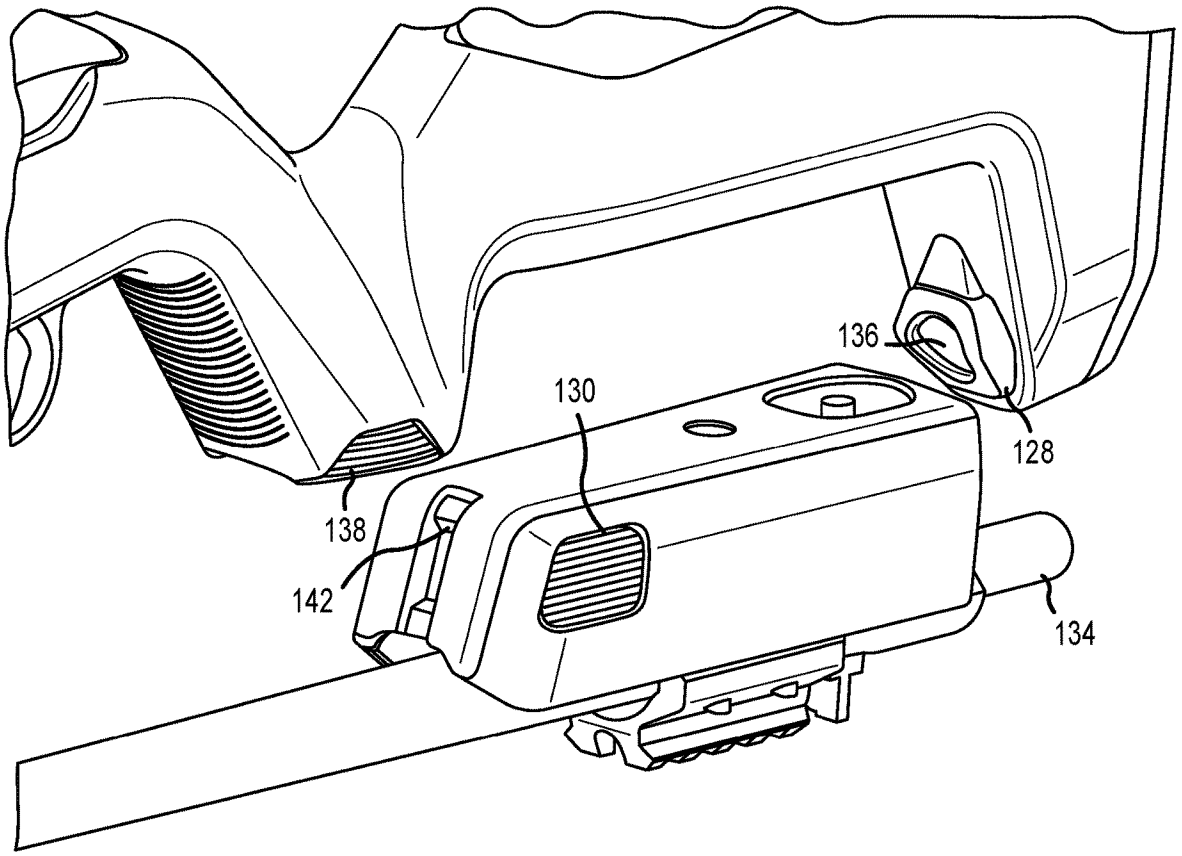
FIG. 5 is a detailed view of a forend assembly of the assembly in FIG. 1.
Figure 29:
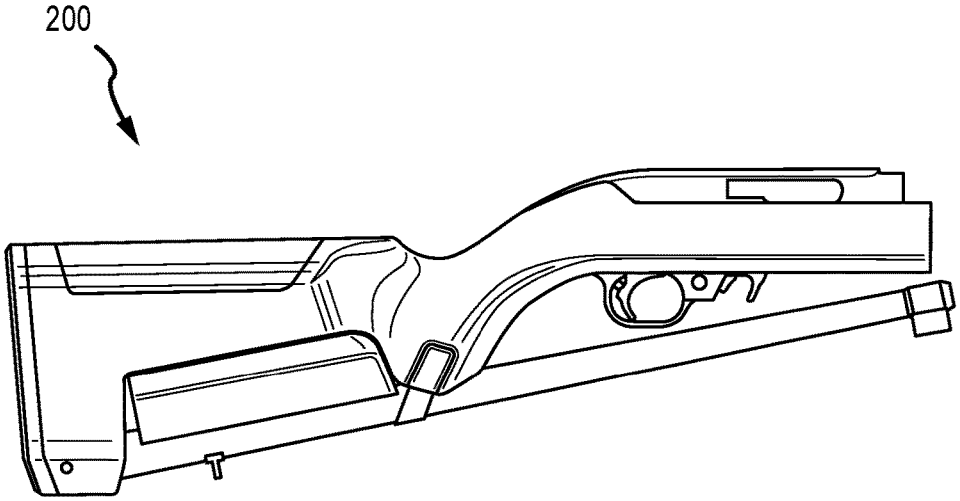
FIG. 29 is a side view of a takedown firearm assembly in a storage configuration.
Figure 30:
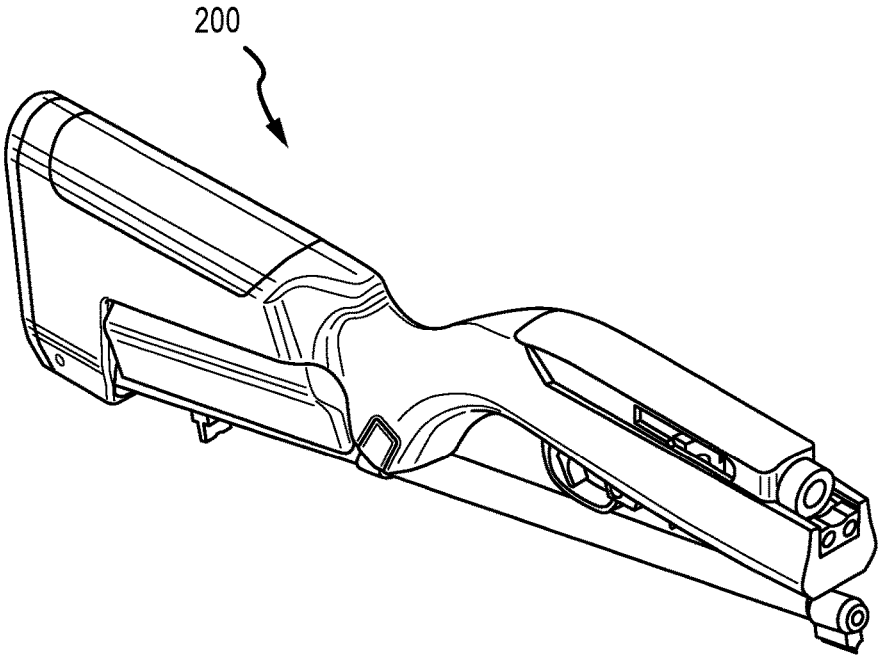
FIG. 30 is a perspective view of the assembly in FIG. 29.
Figure 31:
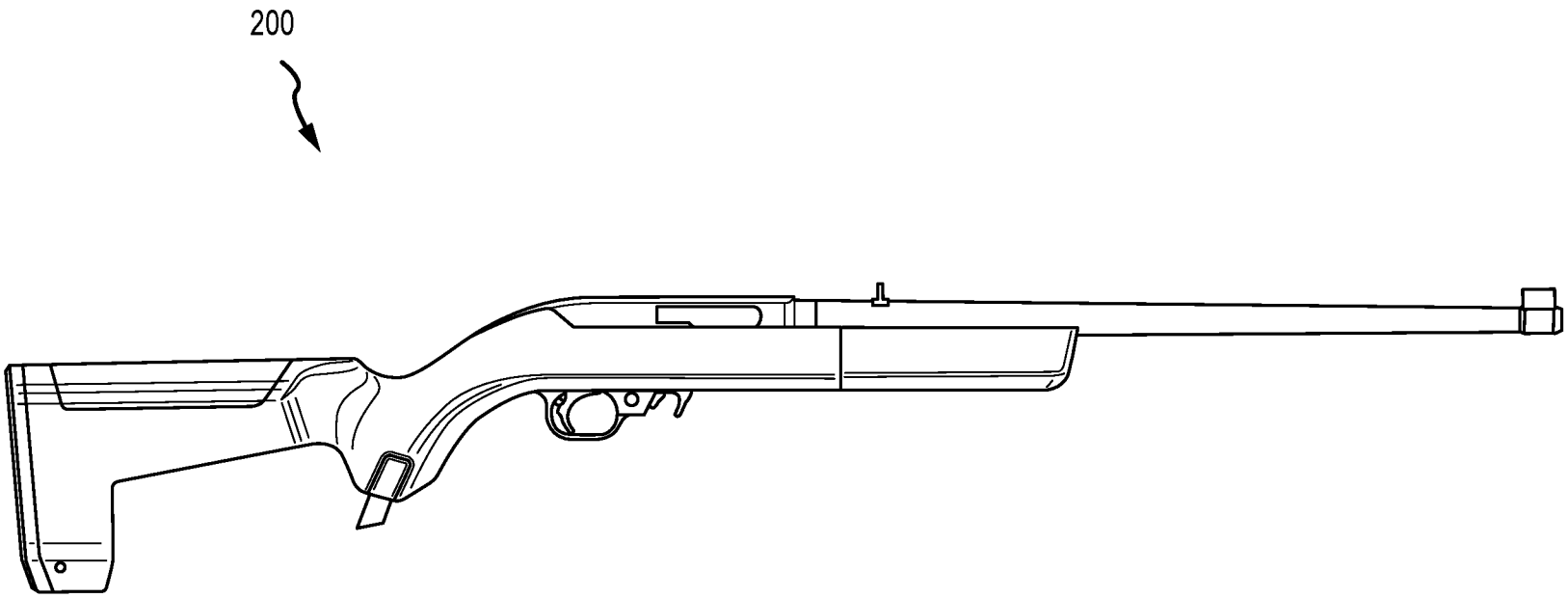
FIG. 31 is a side view of the assembly in FIG. 29 in a deployed configuration.

The forend assembly 104 can include a barrel 124, the barrel 124 having a muzzle 108 at a firing end of the barrel 124. The barrel 124 can be between 16" and 18.5" or greater than 16". In some embodiments, a shorter barrel 124 requiring NFA registration of the firearm may be included. The shorter barrel may be useful to store a sound suppressor (silencer) attached to the shorter barrel and still have the muzzle end of the suppressor protected similarly to a longer barrel. That is, although the Figures illustrate only a barrel 124 supported by the stock assembly 102, in some embodiments, the assembly 102 may support a barrel 124 and a sound suppressor. In some embodiments, a barrel coupled to another elongated mechanism may be supported. The forend assembly 104 can also include the forend 126 configured for coupling to and supporting the barrel 124 in the deployed configuration. In the stowed configuration the forend 126 can fit into the forend assembly storage cavity 110 and be releasably coupled to the stock assembly 102 via one or more releasable fasteners. At the same time, a rear end of the barrel 124 can be releasably coupled to the stock assembly 102 via a barrel receiver 128 (see especially FIGS. 5 and 29).

FIG. 2 illustrates the stowed configuration of the firearm 100 illustrated in FIG. 1. In the stowed configuration, the barrel 124 is faced toward a front of the firearm 100. The forend assembly storage cavity 110 can be shaped to generally form to a shape of the forend 126. For instance, here the forend 126 is generally rectangular with a slight angle at a front end. Accordingly, the forend assembly storage cavity 110 is generally rectangular, but includes a slight angle at the front portion 120 that mimics the angle at the front of the forend 126, but upside down (or flipped vertically). However, the forend assembly storage cavity 110 does not need to perfectly mimic the shape of the forend 126. For instance, at a rear portion 122 of the forend assembly storage cavity 110 one sees that the forend assembly storage cavity 110 is angled to a greater extent than a rear edge of the forend 126 when in the stowed configuration (see FIG. 2).

The forend 126 can include one or two buttons 130 or other release mechanisms that a user can depress in order to release the forend assembly 104 from the stowed configuration. In particular, depressing the two buttons 130 (one on each side of the forend 126) or otherwise operating whatever release mechanism is used, releases a coupling between the tang 118 and the front of the forend 126. In some embodiments, depression of the two buttons 130 or activation of the release mechanism may also be used to couple the forend 126 to the tang 118 and thereby place the firearm 100 into the stowed configuration. The coupling between the tang 118 and the front of the forend 126 will be detailed further relative to FIGS. 5-15.

Figure 3:
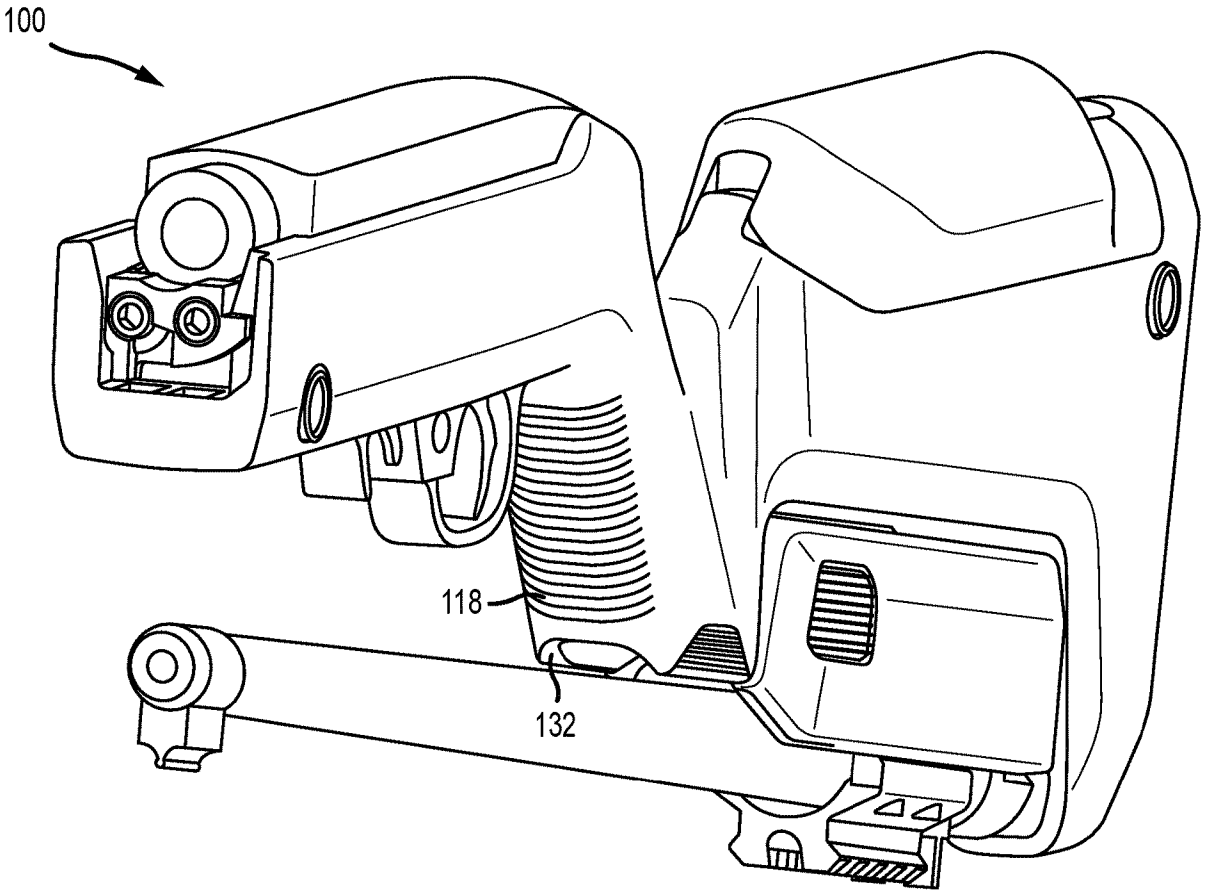
FIG. 3 is a perspective view of the assembly in FIG. 2.
Figure 6:
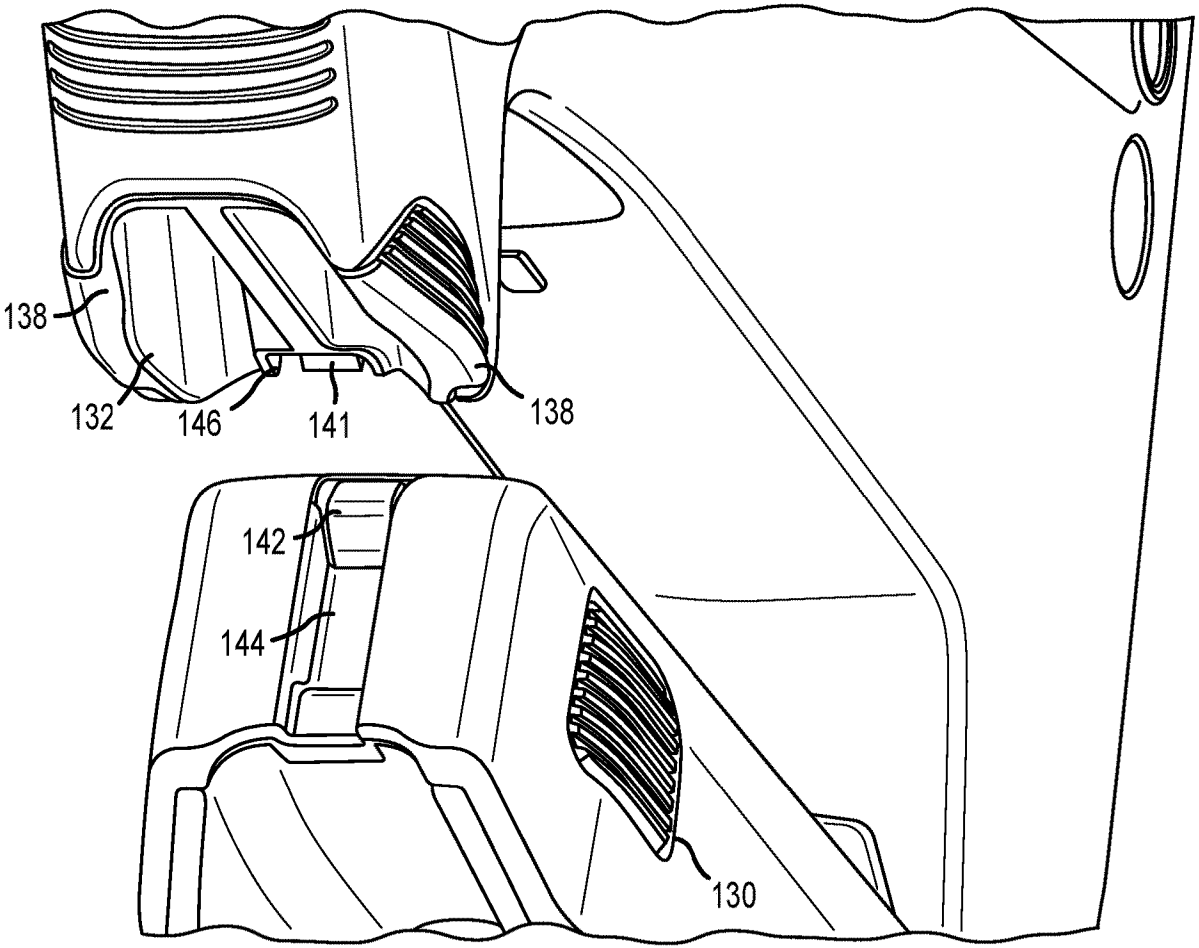
FIG. 6 is another detail view of engagement between a forend assembly and buttstock assembly of the assembly in FIG. 1.

In the illustrated embodiment, a bottom of the tang 118 is shaped to generally replicate or partially surround the barrel 124 (see especially FIGS. 3 and 6). In particular, the bottom of the tang 118 may include a barrel recess 132 to receive or abut the barrel 124 and/or shaped like or similar to the barrel 124 so as to allow the barrel 124 to more closely fit relative to the tang 118 and thereby provide a more compact overall shape of the firearm 100 in the stowed configuration. In the illustrated embodiment the barrel 124 does not touch the tang 118 or the barrel recess 132, although in some embodiments such contact may be desired. More specifically, contact between the barrel 124 and the tang 118 or the recess 132 may provide additional structure, stability, and/or support, which may be particularly beneficial for heavier bull barrels in the stowed condition by offsetting stress and reducing the likelihood of a heavier barrel damaging the latching detent 140 and/or notch 150 during rough handling.

The barrel recess 132 may also be shaped to accommodate a widest barrel 104 diameter expected (e.g., a bull barrel), thus leaving a gap relative to smaller-radius barrels (e.g., a tapered barrel).

FIG. 3 also shows that a bottom of the forend 126 does not contact a top inner surface of the stock assembly storage cavity 110. However, in some embodiments, such contact may be desired.

FIG. 6 shows the bottom of the tang 118 and the forend 126 in a partially exploded view and without the barrel 118. Here, the barrel recess 132 can be seen without obstruction. Further, it is seen that the barrel recess 132 can be formed in part by the tang 118 and in part by a tang insert 138. The tang insert 138 can be seen in isolation in FIG. 8. The tang insert 138 can extend up into the tang 118 and be releasably coupled within the tang 118. In some embodiments, two or more tang inserts 138 can be replaceable and/or arranged within the tang 118, where each tang insert 138 has a barrel recess 132 shaped to fit a different barrel type. For instance, .22 Ruger firearms may be configured with a traditional tapered barrel or with a competition or bull barrel without a taper. Thus, two tang inserts 138 could be used relative to a Ruger .22 firearm 100, where a first tang insert 138 can be shaped to partially surround a tapered barrel and a second tang insert 138 can be shaped to partially surround a bull barrel. The tang insert 138 can be partially exposed outside of the tang 118 to enable a user to remove and replace the tang insert 138.

Figure 7:
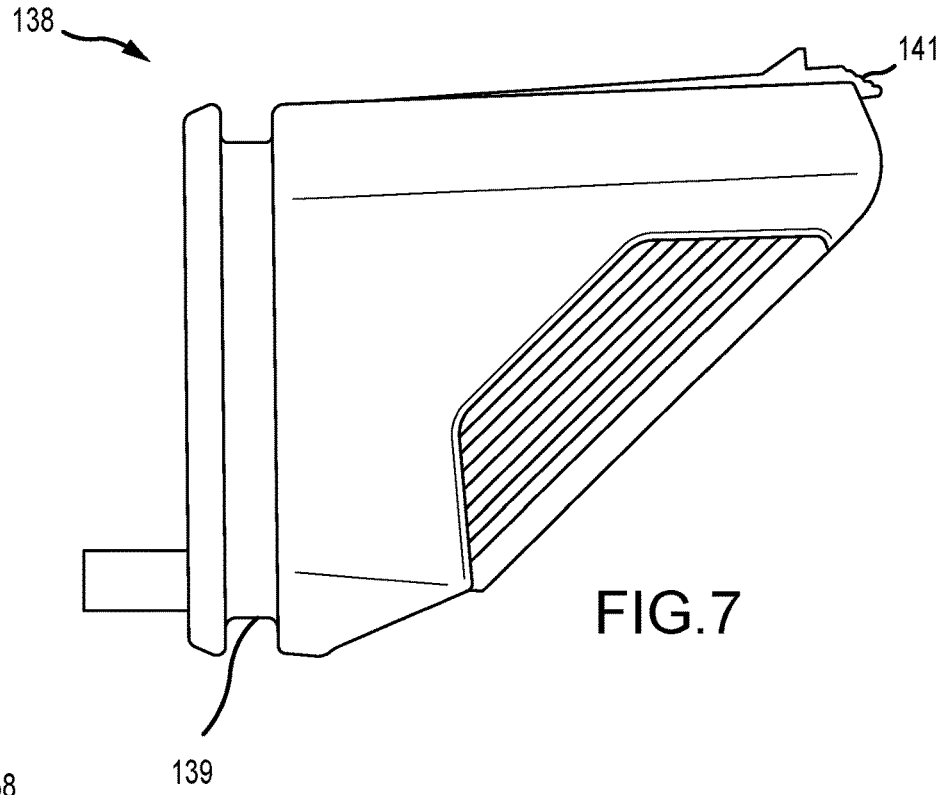
FIG. 7 is a side view of a tang insert suitable for use in the assembly of FIG. 1.

In some embodiments, an engagement between the tang 118 and tang insert 138 may be water-tight and/or include a water-resistant o-ring at a sealing juncture. Those skilled in the art will recognize that FIG. 7 illustrates the tang insert 138 without the water-resistant o-ring seal for clarity. The tang insert 138 may include a recess 139 for receiving a seal (not illustrated).

Figure 4:
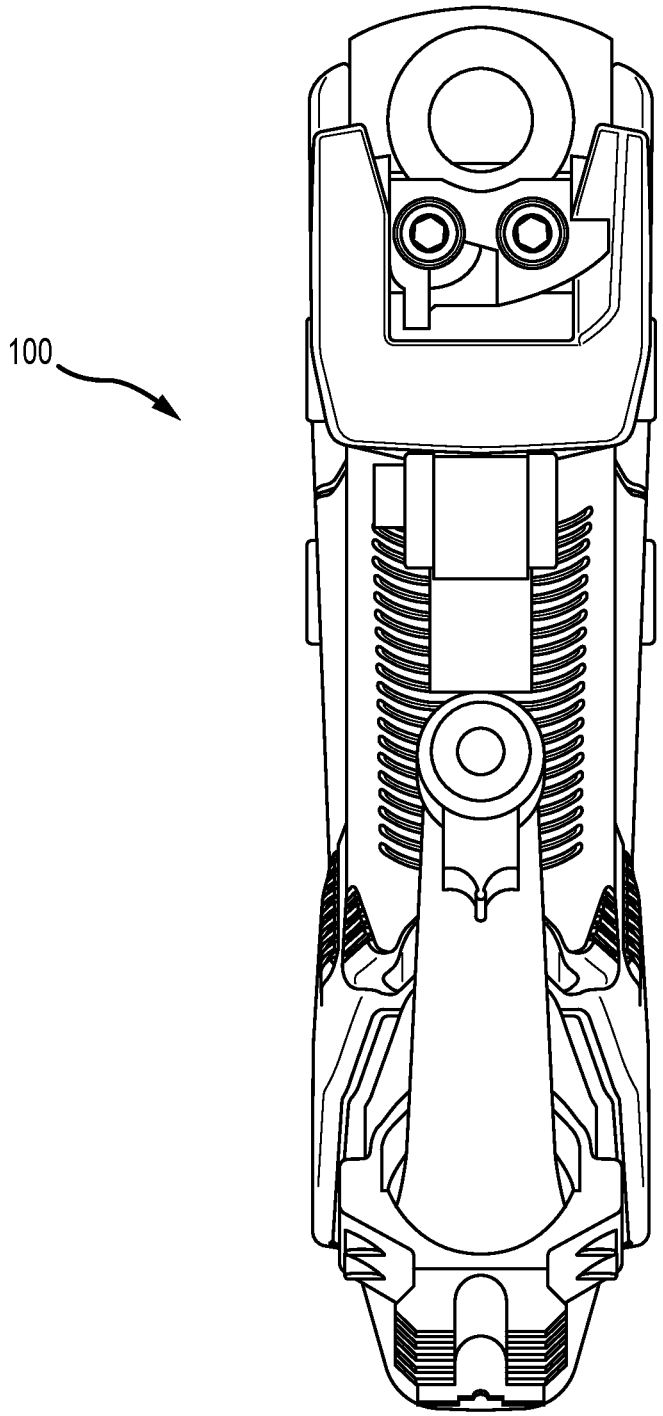
FIG. 4 is an end view of the assembly in FIG. 2.

FIGS. 2-4 show that the forend assembly 104 may be angled from front to back such that the barrel 124 is not in line with the barrel 124 when in the deployed configuration. In other words, the barrel 124 is not in line with or parallel to a longitudinal axis through the receiver when the firearm 100 is in the stowed configuration. The result is a more compact firearm 100 shape in the stowed configuration than if the barrel 124 remained parallel with its alignment in the deployed configuration.

Additionally, the firearm 100 can be shaped such that the muzzle 108 does not extend beyond a front of the stock assembly 102 (i.e., the forend-to-stock interface 106). This, in addition to the barrel's 124 angle helps to protect the muzzle 108 in the stowed configuration. While minor physical impacts to the barrel 124 are unlikely to cause accuracy-degrading damage to the firearm 100, even minor impacts to the muzzle 108 can greatly influence accuracy and even safety of the firearm 100 since the inside of the barrel 124 is exposed at the muzzle 108. To protect the cartridge chamber at the rear end of the forend assembly 104, or the forend assembly 104 side of the forend-to-stock interface 106, the barrel receiver 128 can be shaped and arranged to receive the barrel 124. In this way, the fragile barrel 124 interface that couples to the receiver can be protected as well as the inside of the barrel 124. The barrel receiver 128 can partially surround a portion of the barrel 124. In particular, and with reference to FIG. 5, the barrel 124 can include a barrel shank 134, which extends from a rear of the barrel 124 but has a smaller diameter than the rear of the barrel 124. Typically, this barrel shank 134 is configured to slide into the receiver. In the stowed configuration, the barrel shank 134 can slide into the barrel receiver 128, and in particular, into an aperture 136 in the barrel receiver 128. The aperture 136 can be generally cylindrical and have a generally circular or ovular opening and can recess into the buttstock 114 far enough to allow the barrel shank 134 to fit within the barrel receiver 128 (and within the buttstock 114).

Figure 26:
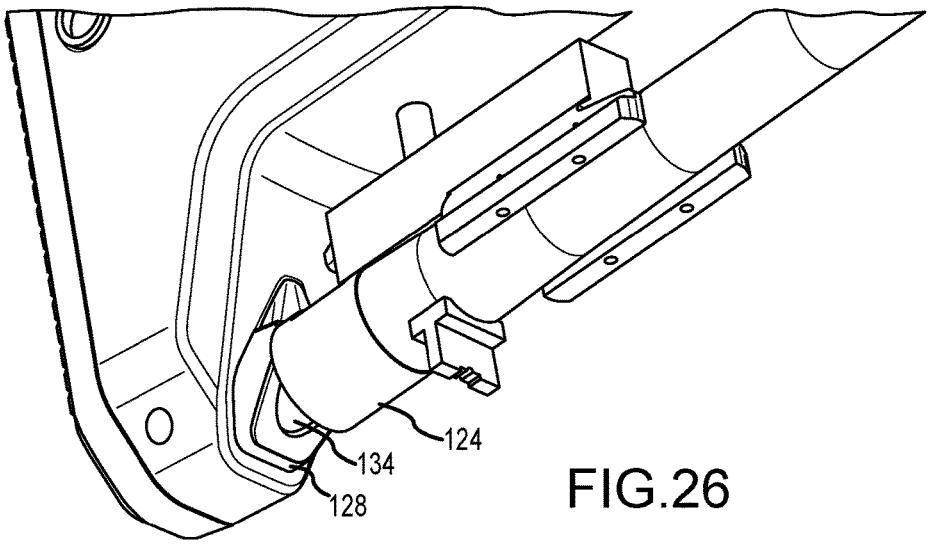
FIG. 26 is a detail view of an engagement between a barrel and an aperture of the assembly in FIG. 1.
Figure 27:
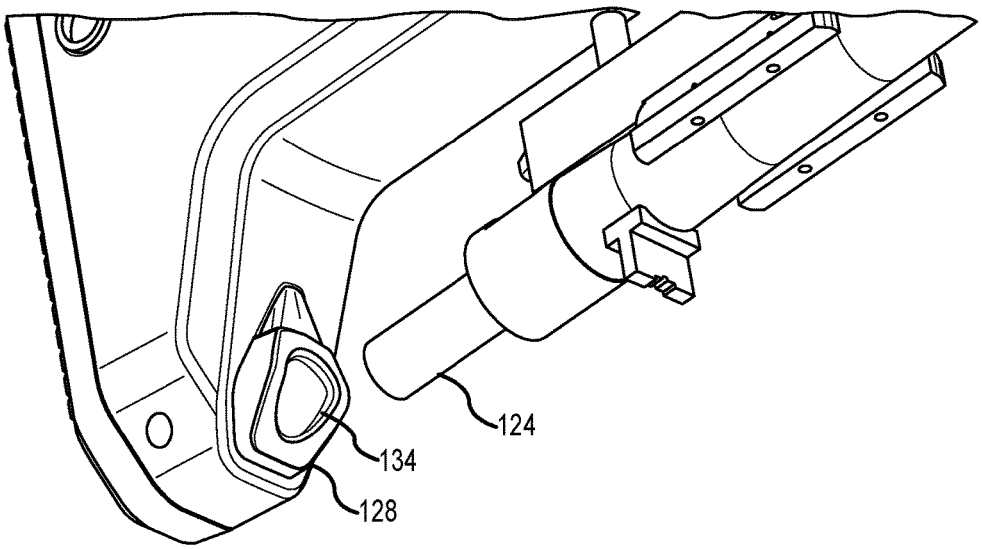
FIG. 27 is a detail view of some components of the assembly in FIG. 1.
Figure 28:
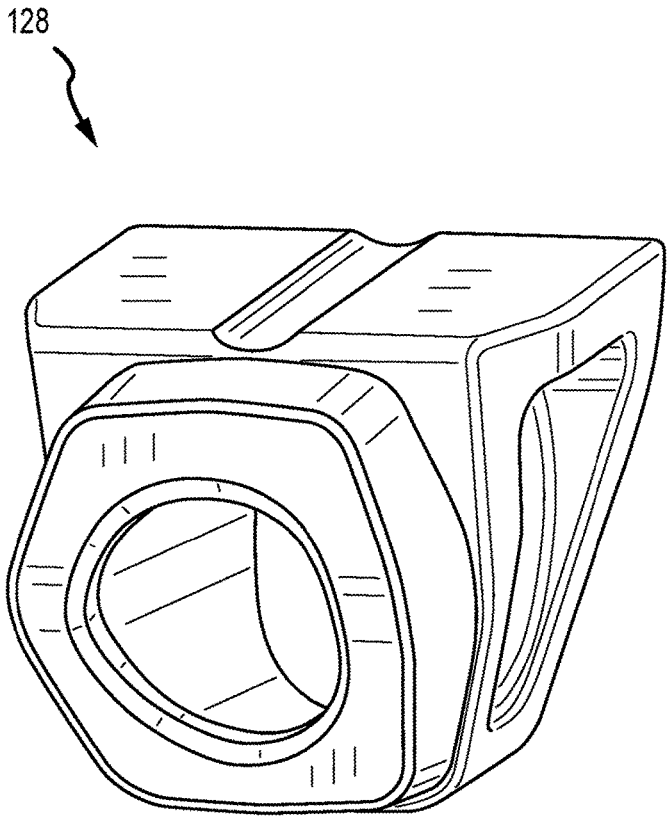
FIG. 28 is a detail view of a component of the assembly in FIG. 1.

Because a front of the forend 126 may need to be lowered after being released before the forend assembly 104 could be moved forward, and thus decouple the barrel 124 from the barrel receiver 128, the aperture 136 may be ovular and generally vertically oriented, such that the barrel shank 134 could pivot up and down within the aperture 136. In this way, the forend assembly 104 may first be released at a front 120 of the forend assembly storage cavity 110, then pivoted downward about a pivot point at the barrel receiver 128 or rearward thereof until the forend 126 cleared the tang 118, and then the barrel shank 134 may be slid out of the aperture 136 with the forend 126 moving forward but below the tang 118. In some embodiments, the barrel receiver 128 is made of a rubberized thermoplastic material. The barrel receiver 128 may have an ovular aperture or may simply flex with the barrel as the barrel 124 is rotated out. This describes the actions and movements for releasing the forend assembly 104 from the stowed configuration, and a reverse of this procedure would allow stowage of the forend assembly 104. However, for stowage, the two buttons 130 or other release mechanism may or may not need to be depressed or activated in order to stow the forend assembly 104. See FIGS. 26-28 for additional views of these interactions. The release mechanism may include a detent or snap-fit type mechanism for receiving and securing the forend assembly.

Thus, the forend 126 can releasably couple to a front 120 of the stock assembly storage cavity 110, and be released therefrom via operation of the release mechanism or depression of the two buttons 130, or another release mechanism. The forend 126 can also slidingly engage with a rear 122 of the stock assembly storage cavity 110, in particular via a sliding engagement between the barrel 124 (or a barrel shank 134 thereof) and the barrel receiver 128.

FIGS. 28-32 show alternative views of an embodiment of the interaction between the barrel shank 134 and the barrel receiver 128. However, the forend 126, except for the barrel tray 154, has been removed to ease visibility of the barrel 124 and the barrel tray 154. One can see that by affixing the barrel shank 134 in the barrel receiver 128, the breach of the firearm 100 is protected when in the stowed configuration. Additionally, by interacting with or attaching via the barrel shank 134, which is typically consistent across a given caliber, rather than the barrel, which can vary for a given caliber, different barrels can be used with the firearm 100 without having to adjust any components of the stock assembly 102.

The forend 126 can include a first latching detent 140 that releasably interfaces with a notch 150 (see FIG. 1) of the tang 118. These are most easily seen in FIGS. 1 and 6-9. When the first latching detent 140 is pushed forward into the notch 150, this pushes the forend assembly 104 down. The first latching detent 140 can be coupled to the two buttons 130 or other release mechanism, and the interaction therebetween can be more clearly seen in FIGS. 9-15. The first latching detent 140 can extend through an aperture 143 (see FIG. 12) in the forend 126 and can reside at least partially within a recess or valley 144 in the front of the forend.

At the same time, a tang locking tab 141 (see FIGS. 6-8) that may be part of the tang insert 138 can flexibly clasp onto a bottom rim of the tang 118 to help hold the tang insert 138 within the tang 118. The tang locking tab 141 can be arranged on an end of a cantilever set into a channel 146 in the tang insert 138. The tang 118 may also include a tang ridge 148 that is shaped to fit into the valley 144 in the front of the forend 126. Thus, the illustrated embodiment may include three interfaces between the tang 118 and a front of the forend 126 that help to maintain the forend assembly's 104 position in the stowed configuration.

Figure 8:
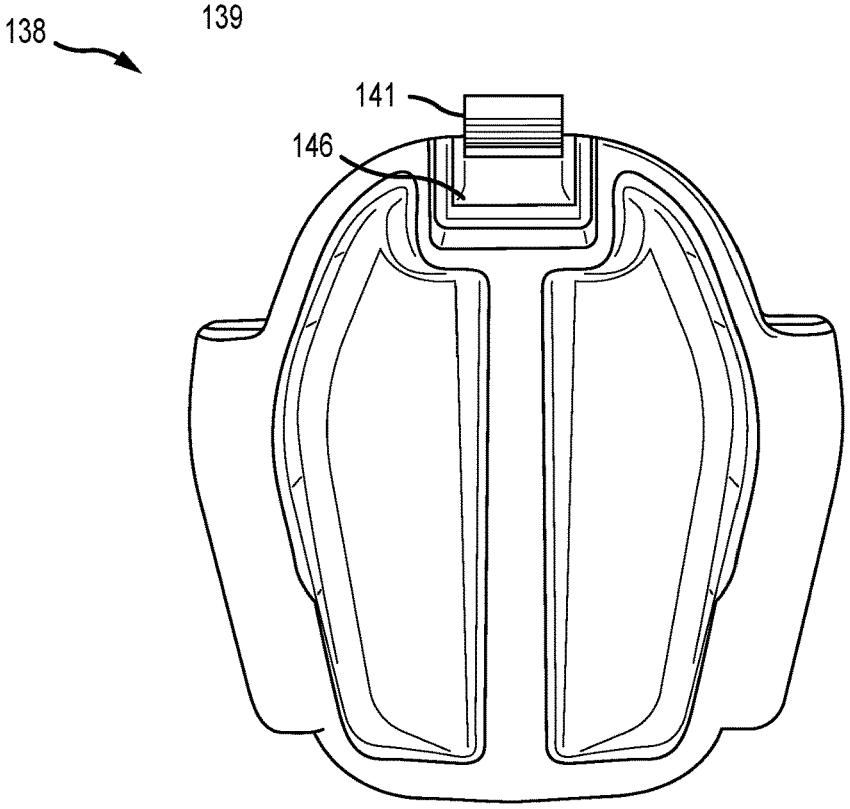
FIG. 8 is an end view of the tang insert in FIG. 7.

FIGS. 7 and 8 illustrate side and front views, respectively, of the tang insert 138. One can see that the cantilever that holds the tang locking tab 141 is angled slightly relative to a top surface of the tang insert 138 in FIG. 7. This angle may provide a molded-in preload to retain the tang insert 138 within the tang 118.

Figure 9:
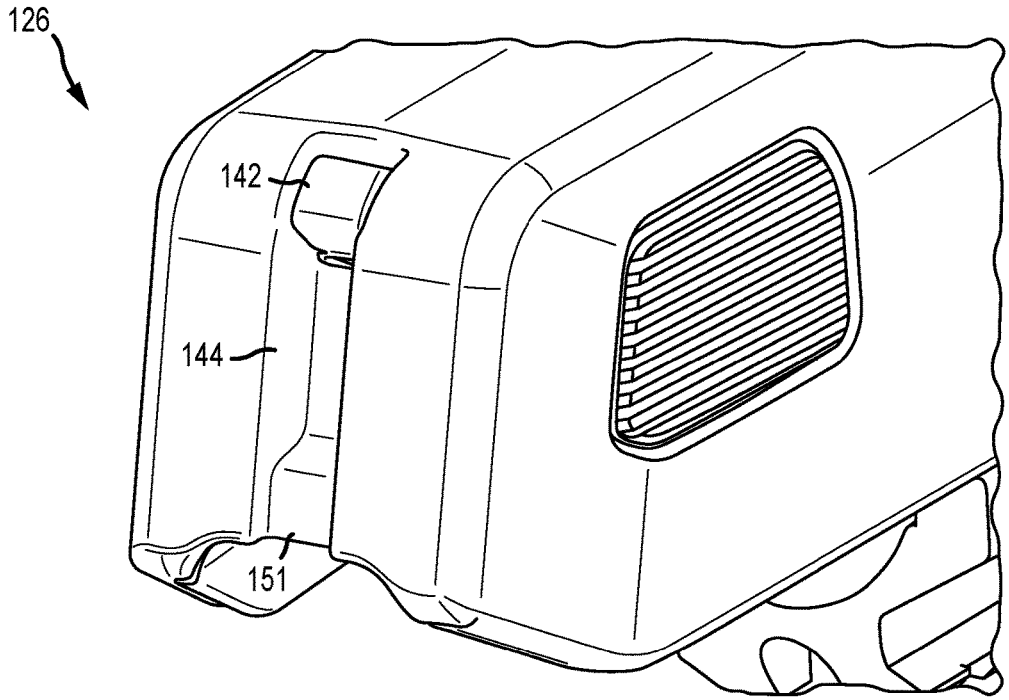
FIG. 9 is a detail view of the forend assembly in FIG. 1.

FIG. 9 illustrates a detailed view of the front of the forend 126 without a barrel 124. At the bottom of the valley 144 is a detent 151 that partially surrounds the tang ridge 148 and helps retain a releasable interaction between the tang ridge 148 and the valley 144.

Figure 10:
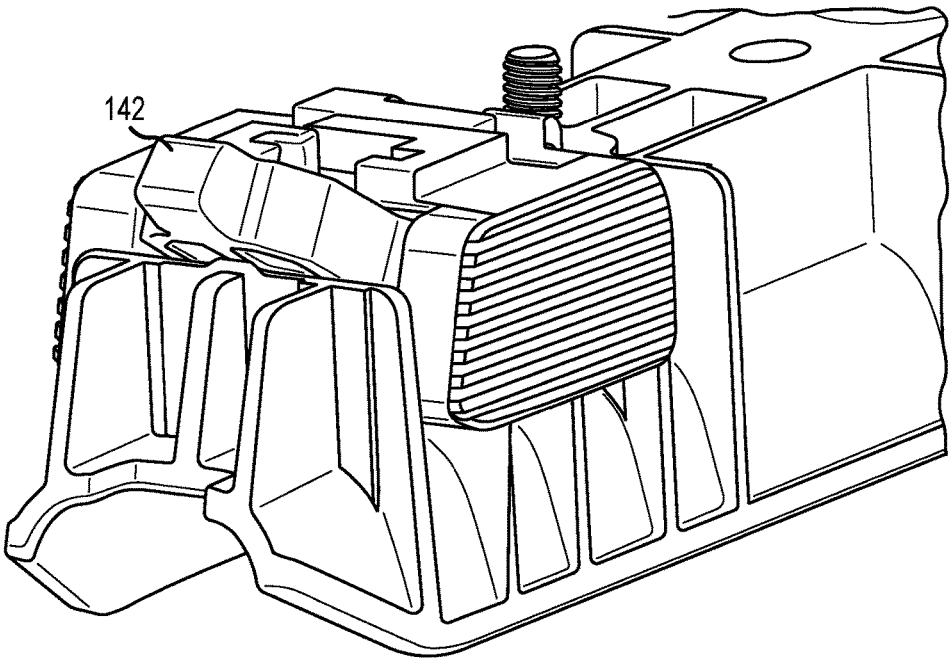
FIG. 10 is a detail view of some components of the forend assembly in FIG. 1.
Figure 11:
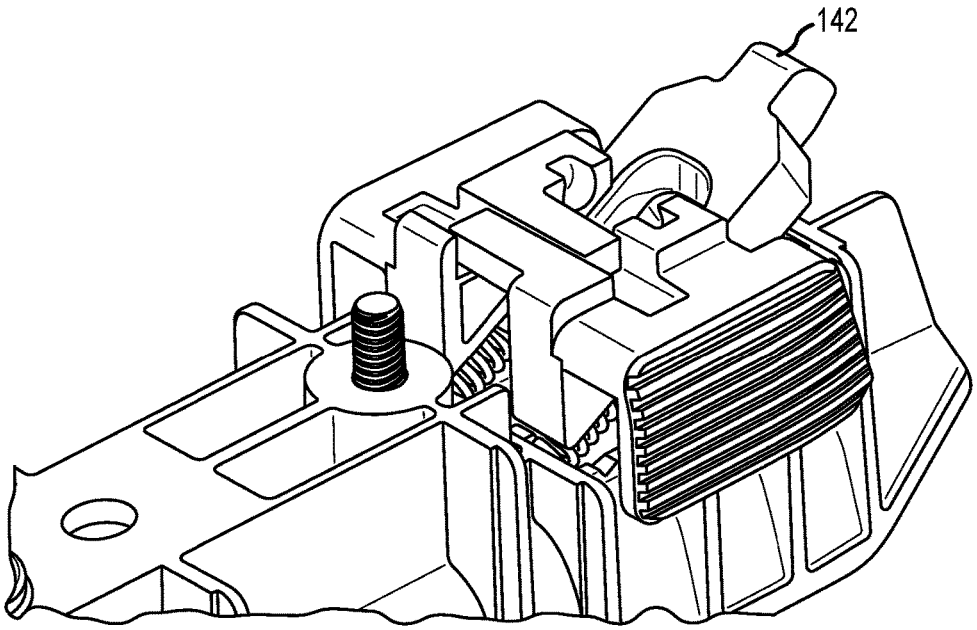
FIG. 11 is a detail view of some components of the forend assembly in FIG. 1.
Figure 12:
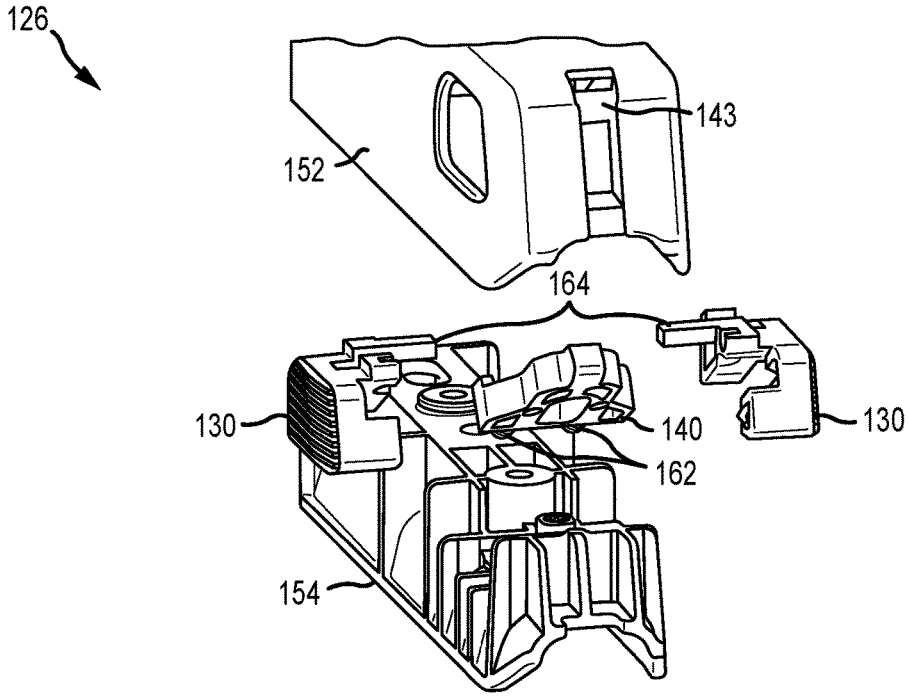
FIG. 12 is an exploded detail view of some components of the forend assembly in FIG. 1.
Figure 13:
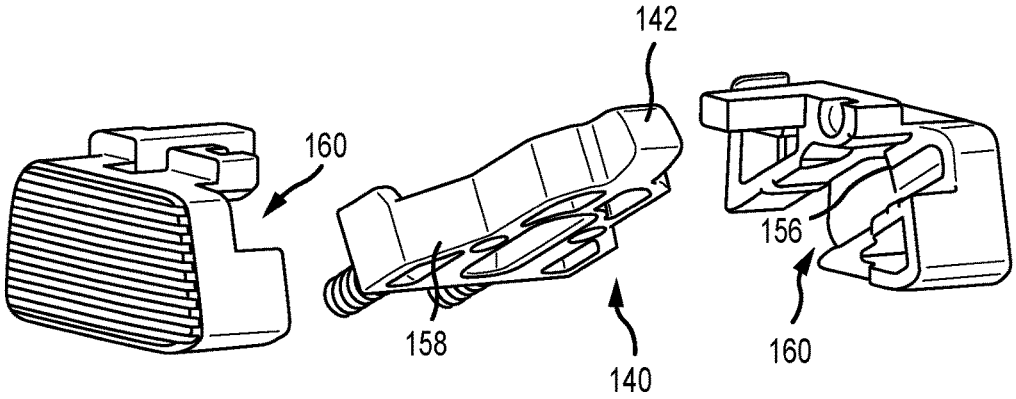
FIG. 13 is an exploded detail view of some components of a forend release mechanism in FIG. 1.
Figure 14:
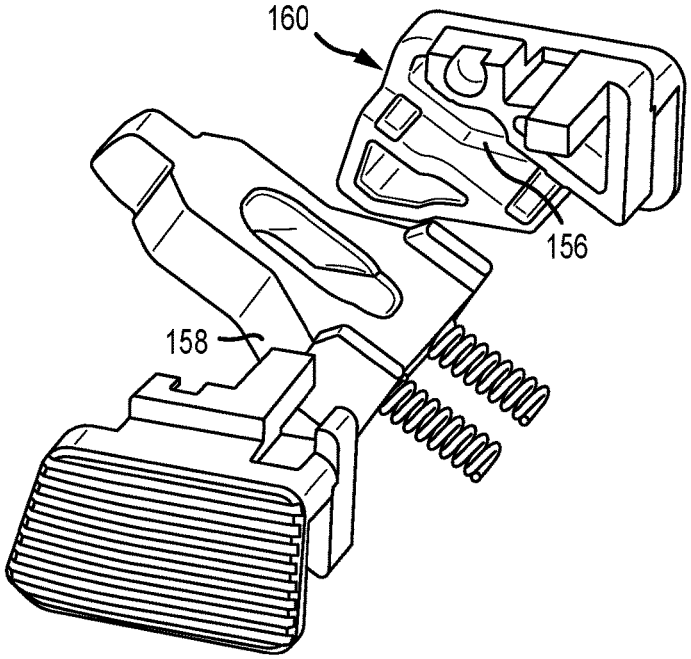
FIG. 14 is an exploded detail view of the mechanism in FIG. 13.

FIGS. 10-12 expose the inside of the forend. The forend 126 can include a forend shell 152, a barrel tray 154, two buttons 130, and the first latching detent 140. The buttons 130 can include interior angled surfaces 156 configured to interface with angled surfaces 158 (see especially FIG. 13) of the first latching detent 140, such that when the buttons 130 are depressed inward, the first latching detent 140 is forced backward to disengage a forward portion 142 or flange 142 of the detent 140 from the notch 150 (compare FIG. 1 with FIG. 9).

Figure 15:
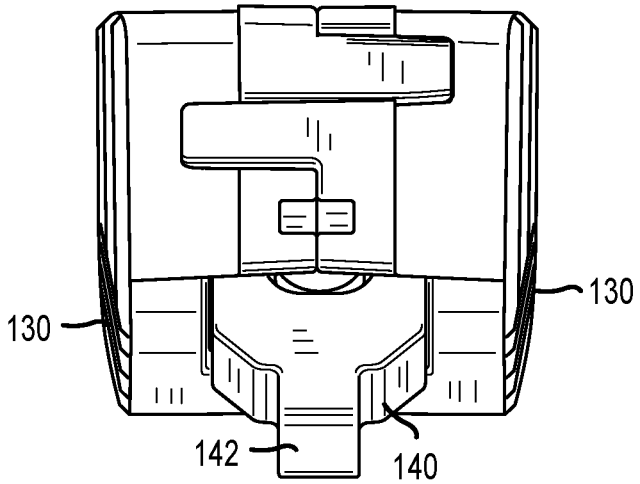
FIG. 15 is a series of views of the mechanism in FIG. 13.
Figure 15:
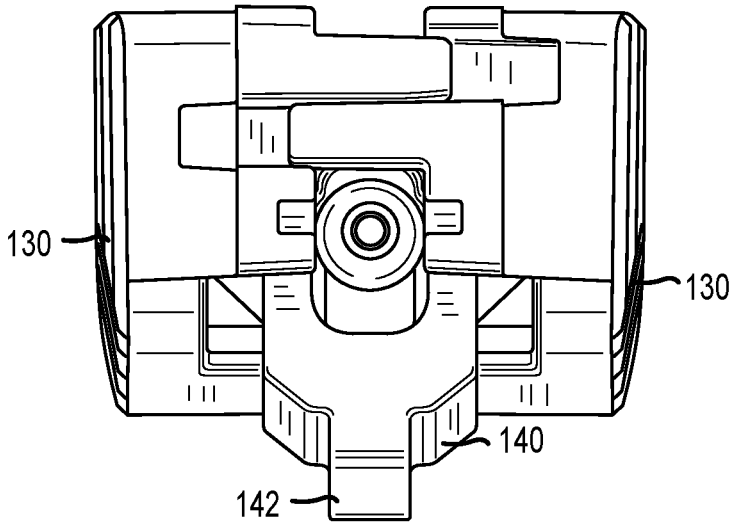

FIG. 15 illustrates the buttons 130 and the first latching detent 140 in two different positions—the top image showing the buttons 130 depressed and the first latching detent 140 forced backwards into a released position, and the bottom image showing the buttons 130 in a relaxed or non-depressed position such that the first latching detent 140 is in a relaxed and forward position (e.g., a latched position). In this way, the first latching detent 140 retracts from a latching position relative to the notch 150 and thereby releases the forend assembly 104. The buttons 130 can also include channels 160 shaped to guide travel of the first latching detent 140. The interior angled surfaces 156 can be arranged within these channels 160.

The first latching detent 140 may include one or more springs 162 that bias the first latching detent 140 forward to cause part of the flange 142 to extend out of the aperture 143. The buttons can include fingers 164 that interlace and help the buttons 130 to remain aligned while moving toward and away from each other.

Figure 17:
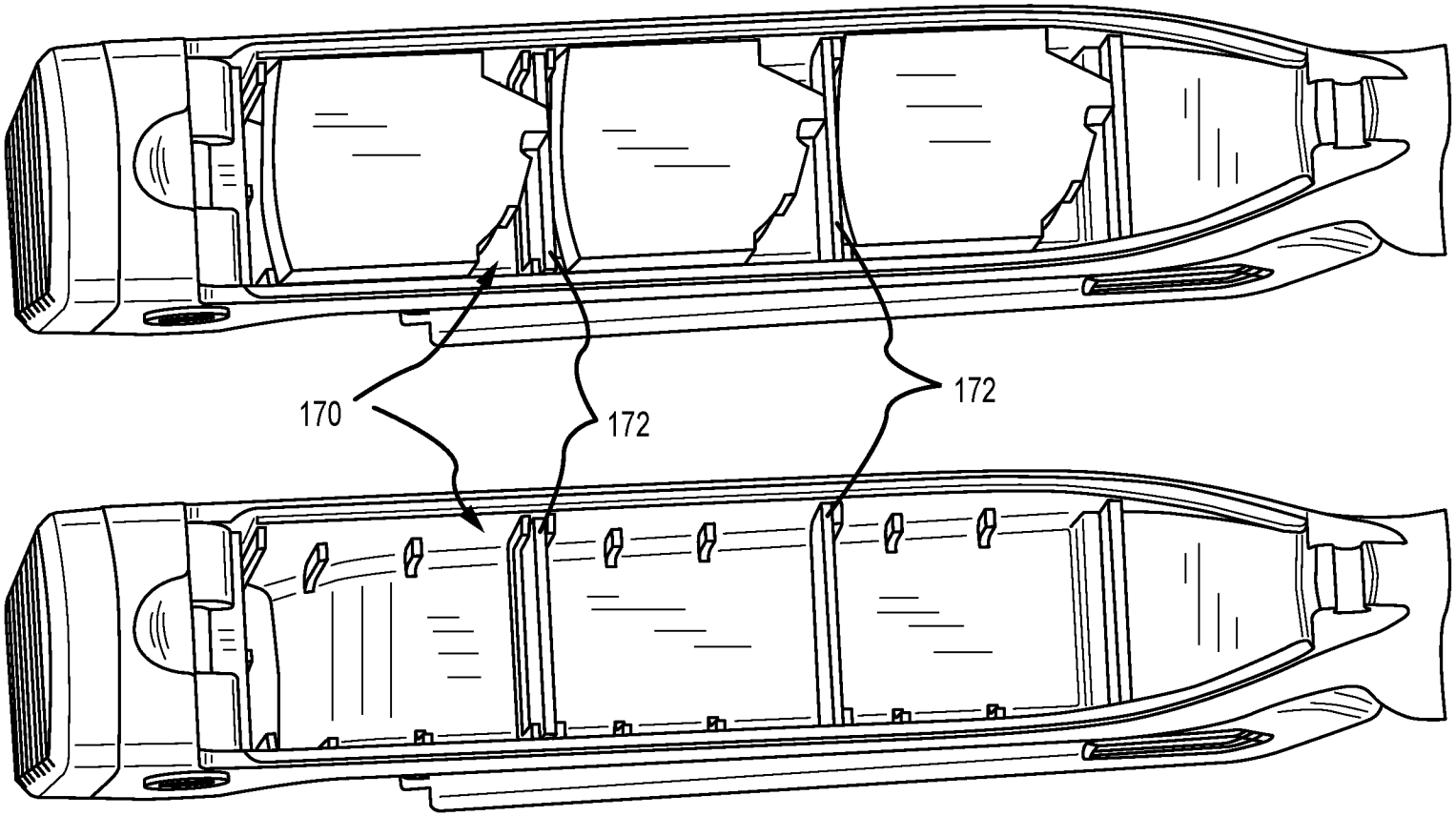
FIG. 17 is a top view of the storage compartment of the assembly in FIG. 1 with and without magazines.

FIGS. 16-17 illustrate an embodiment of the magazine/cartridge storage that can be built into the stock assembly 102 of the firearm 100. The stock storage compartment 170 can include a variety of cheek pieces 116, where two examples are shown in FIG. 16. The one on the right of FIG. 16 provides greater storage and/or a higher resting place for a user's cheek. The illustrated storage is for three .22 caliber magazines 166 oriented generally perpendicular to an axis passing through the receiver and barrel. Each magazine 166 has its own compartment. The cheek piece 116 may be configured to make a sealed or water resistant or water tight seal relative to the rest of the stock assembly 102, although those skilled in the art will recognize this is an optional feature. Locating the storage compartment 170 on a top of the stock assembly 102 eases access to stored items for a user. Also, by orienting the storage vertically, each of the sub compartments within the stock storage compartment 170 can be individually accessed without disrupting the other sub compartments and items stored therein. Separator walls 172 can be arranged between each sub compartment and can be removable. In this way, the three illustrated compartments can be turned into one large compartment with removal of both of the separator walls 172. Alternatively, removal of one separator wall 172 can enable one medium sized storage compartment and one smaller compartment. In some embodiments more than three sub compartments can be formed, and hence more than two separator walls 172 can be implemented. In some embodiments, one or more of the separator walls 172 can be fixed rather than removable.

Figure 18:
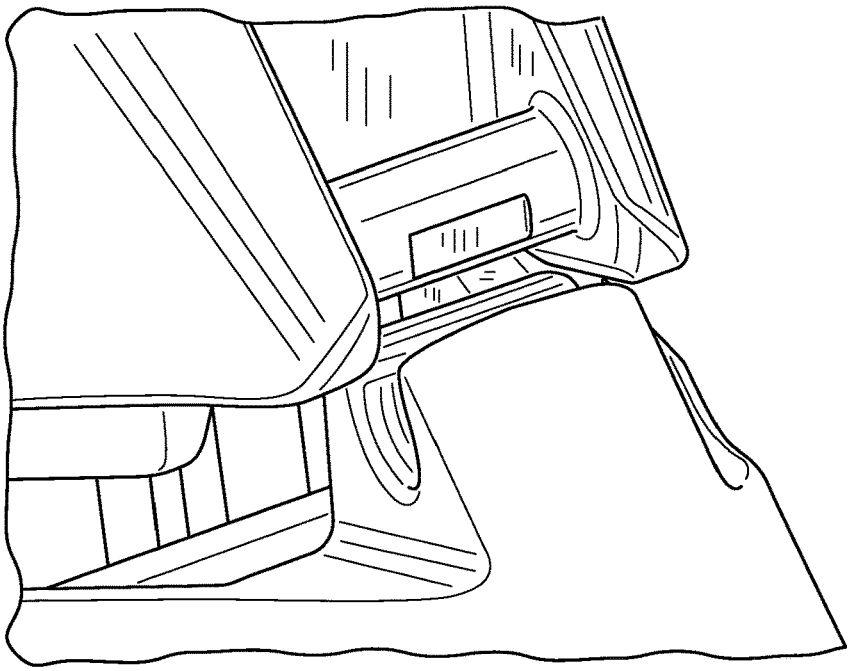
FIG. 18 is a detail view of an engagement for the cheekpieces in FIG. 16.
Figure 19:
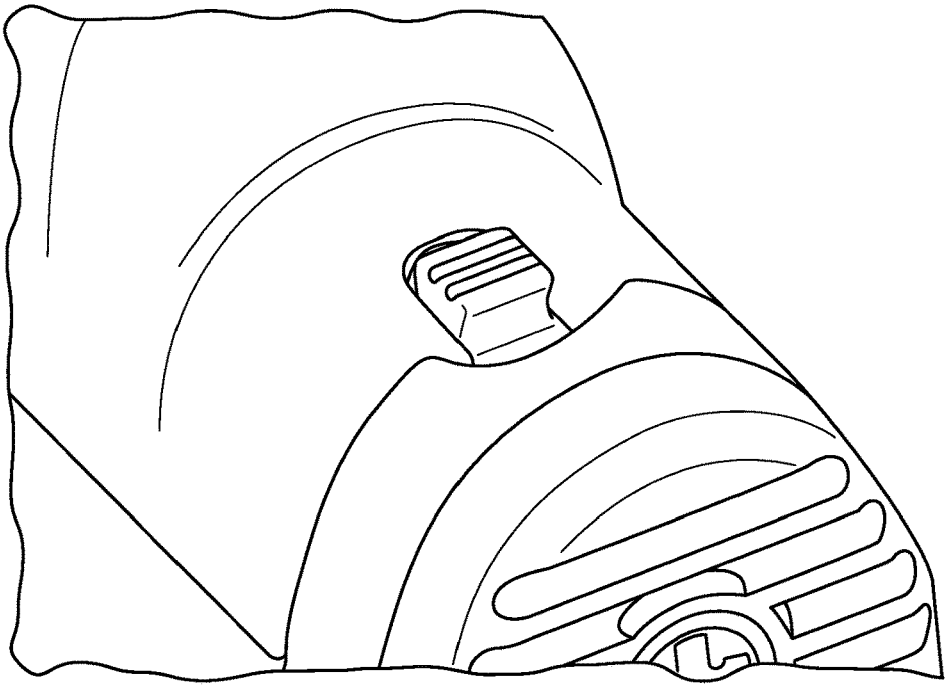
FIG. 19 is a detail view of an engagement for the cheekpieces in FIG. 16.
Figure 20:
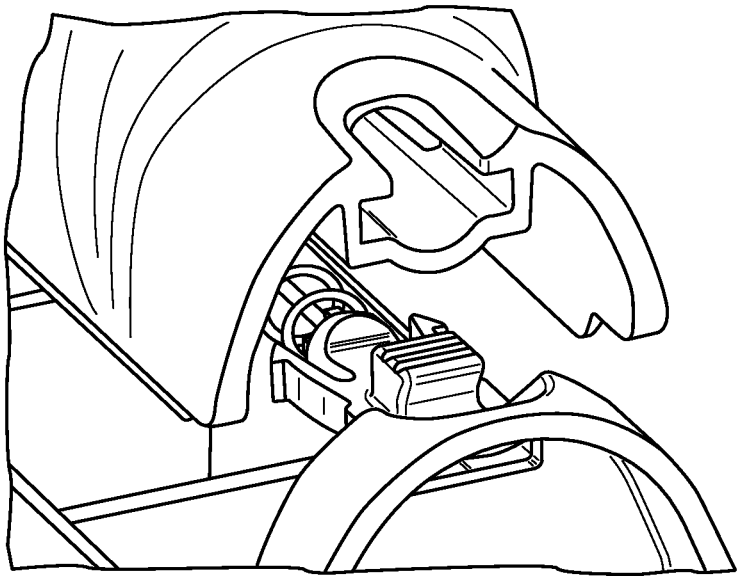
FIG. 20 is a detail view of an engagement for the cheekpieces in FIG. 16.

FIGS. 18-20 illustrate various aspects of an attachment assembly that releasably attaches the cheek piece 116 to the stock assembly 102.

Figure 21:
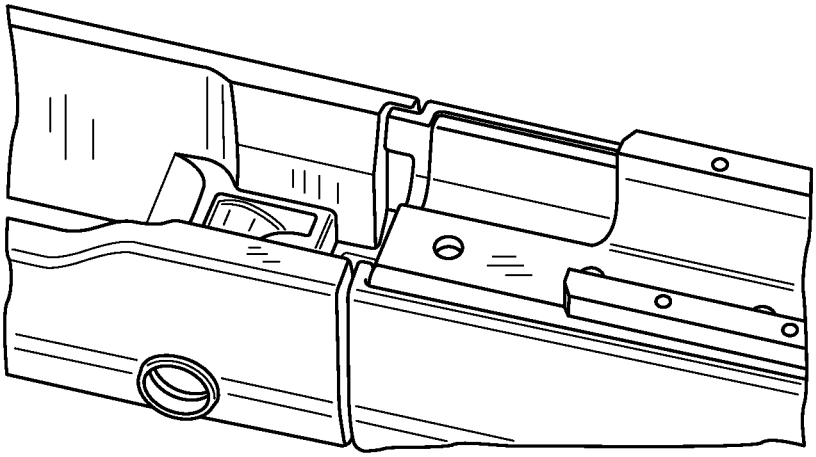
FIG. 21 is a detail view of an engagement between the forend and the buttstock assembly of the assembly in FIG. 1.

FIG. 21 illustrates an embodiment of the stock-to-forend interface 106 where the barrel, receiver, bolt, and trigger assembly have been removed.

Figure 22:
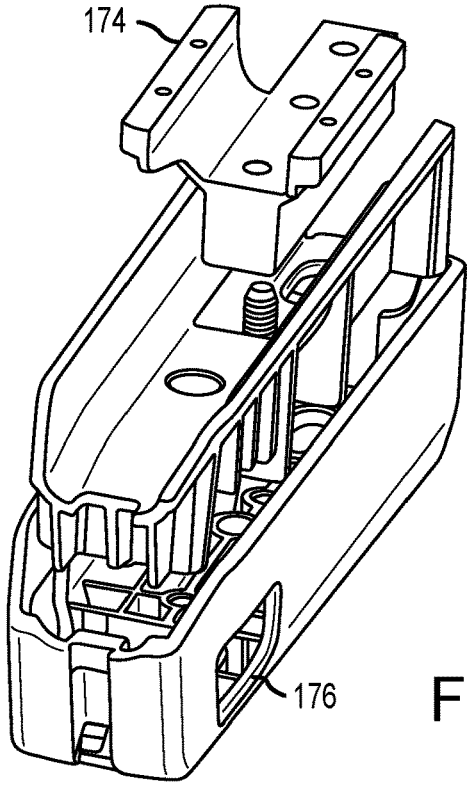
FIG. 22 is an exploded view of the forend assembly of the assembly in FIG. 1.
Figure 23:
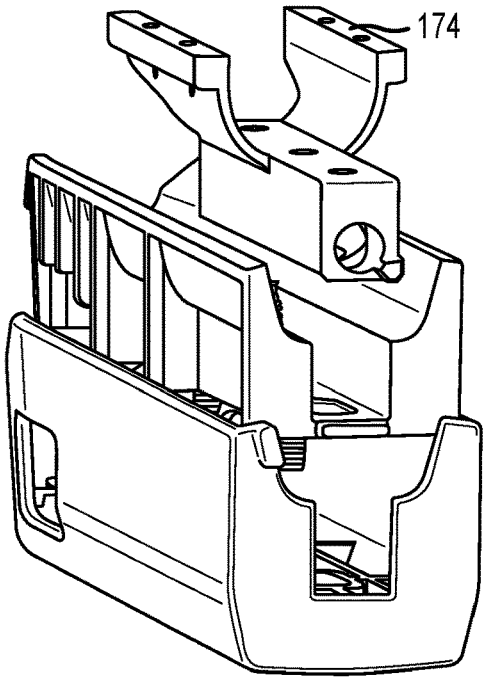
FIG. 23 is another exploded view of the forend assembly.

FIG. 22 illustrates an exploded view of the forend 126. In this view an optional barrel block 174 can be seen and when in place it rests partially below a surface of the barrel tray 154 that supports and contacts a bottom of the barrel. The barrel block 174 can be an OEM or aftermarket barrel block 174 and it can be configured for coupling to a scope mount. In some embodiments the barrel block 174 can be replaceable and different barrel blocks 174 can have different inner radii, such that different barrel types can be accommodated merely by changing the barrel block 174. In some embodiments, the barrel block 174 can be replaced by an insert that is flush with the inner surface of the barrel tray 154 so as to accommodate a barrel that maxes out the inner dimensions of the barrel tray 154. FIGS. 22 and 23 also show two button apertures 176 in sides of the forend 126 where the two buttons 130 extend and can pass through.

Figure 24:
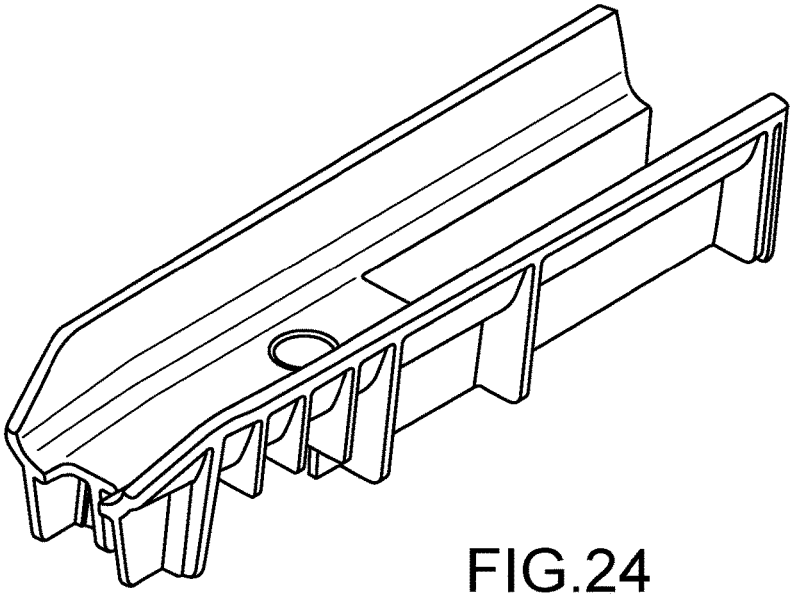
FIG. 24 is a perspective view of a barrel tray for use in the assembly in FIG. 1.
Figure 25:
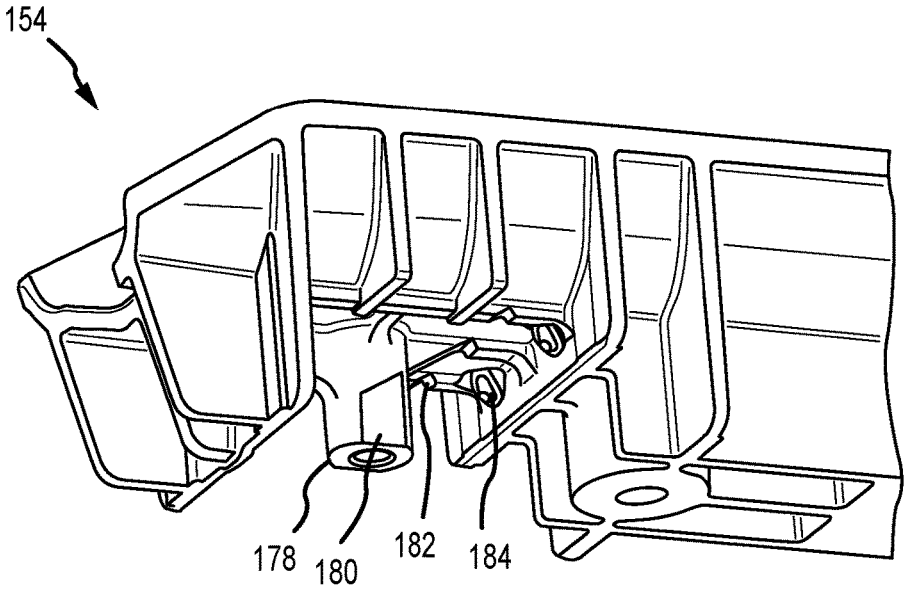
FIG. 25 is a perspective detail view of the barrel tray.

FIGS. 24-25 illustrate a barrel tray 154 and one embodiment of an underside of a barrel tray 154. A fastener column 178 can include an aperture there through that is coaxial with the cylindrical shape of the fastener column 178. A fastener, such as a screw or bolt, can be passed through the aperture and used to connect the barrel tray 154 to the forend shell 152. The fastener column 178 can include chamfers 180 on either side that have angled tops to the chamfers 180 and the barrel tray 154 can include one or more notches 182, the combination of the chamfers 180 and the notches 182 can accommodate the first latching detent 140, especially when the first latching detent 140 is pressed backward into the released position. The barrel tray 154 can also include two spring attachment points 184, each accepting a rear of the springs 162 (recall FIG. 12) and helping the springs 162 to remain in position during movement of the first latching detent 140.

FIGS. 29-32 illustrate some embodiments of a firearm where a forend assembly can be stored in a cavity within a stock assembly. More specifically, the barrel may be passed into a passage in the buttstock assembly and then supported in the aperture in the buttstock assembly.

A stock assembly for a takedown firearm may include a buttstock assembly, and a forend assembly removably couplable to the buttstock assembly at a first location and a second location. When the forend assembly is coupled to the buttstock at the first location, the forend assembly is positioned to support a barrel of the firearm in a longitudinal firing position. When the forend assembly is coupled to the buttstock at the second location, the forend assembly is positioned to support the barrel at an angle relative to the longitudinal firing position.

The stock assembly may include a release mechanism for coupling the buttstock and the forend. The release mechanism may include a detent engagement between the buttstock and the forend and/or a lever engagement between the buttstock and the forend. The release mechanism may have a button and a detent engagement, the button configured to release the detent engagement when depressed. The release mechanism may include a plurality of buttons and a detent engagement, the buttons configured to release the detent engagement when depressed.

The buttstock assembly may have a storage compartment, the storage compartment having a detachable cheekpiece forming a top portion of the storage compartment, and a release mechanism for enabling detachment of the cheekpiece.

Figure 32:
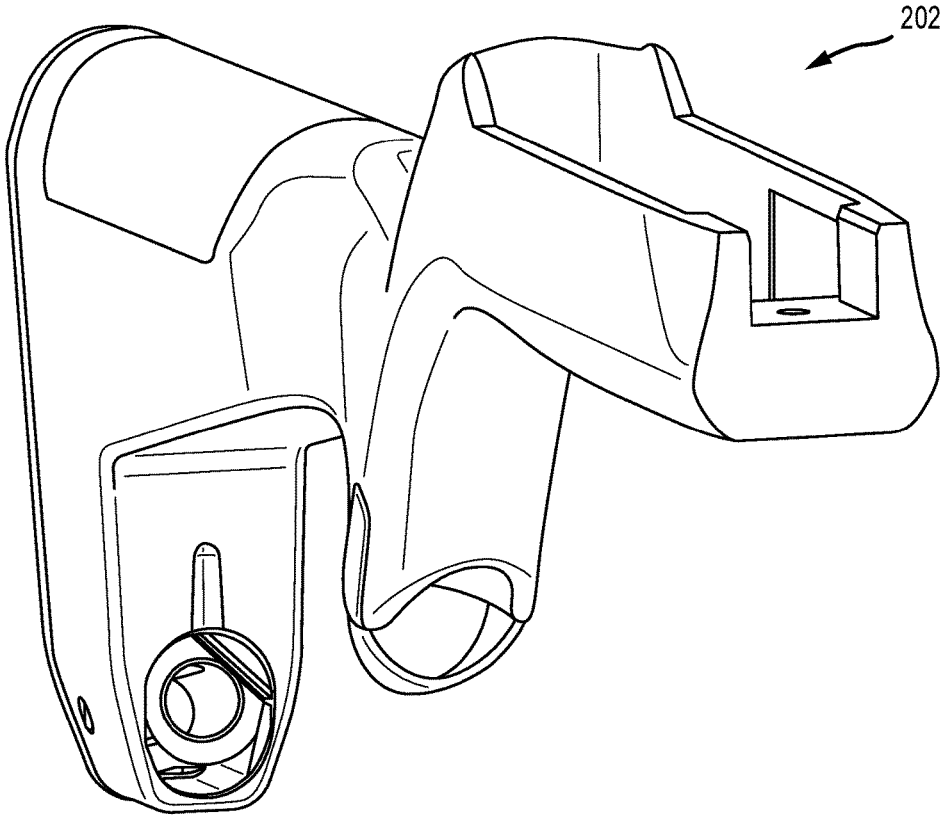
FIG. 32 is a detailed perspective view of a component of the assembly in FIG. 29.

The buttstock assembly may have an aperture for receiving a barrel shank on the barrel and a passage for supporting the barrel, as most clearly illustrated in FIG. 32.

A takedown firearm may include a stock assembly having (a) a buttstock assembly; and (b) a forend assembly removably couplable to the buttstock assembly at a first location and a second location; wherein when the forend assembly is coupled to the buttstock at the first location, the forend assembly is positioned to support a barrel of the firearm in a longitudinal firing position; and when the forend assembly is coupled to the buttstock at the second location, the forend assembly is positioned to support the barrel at an angle relative to the longitudinal firing position. The takedown firearm may include a barrel removably coupled to the forend, the barrel having a barrel shank, the barrel shank configured to engage an aperture in the buttstock assembly when the forend assembly is coupled to the buttstock at the second location.

Figure 33:
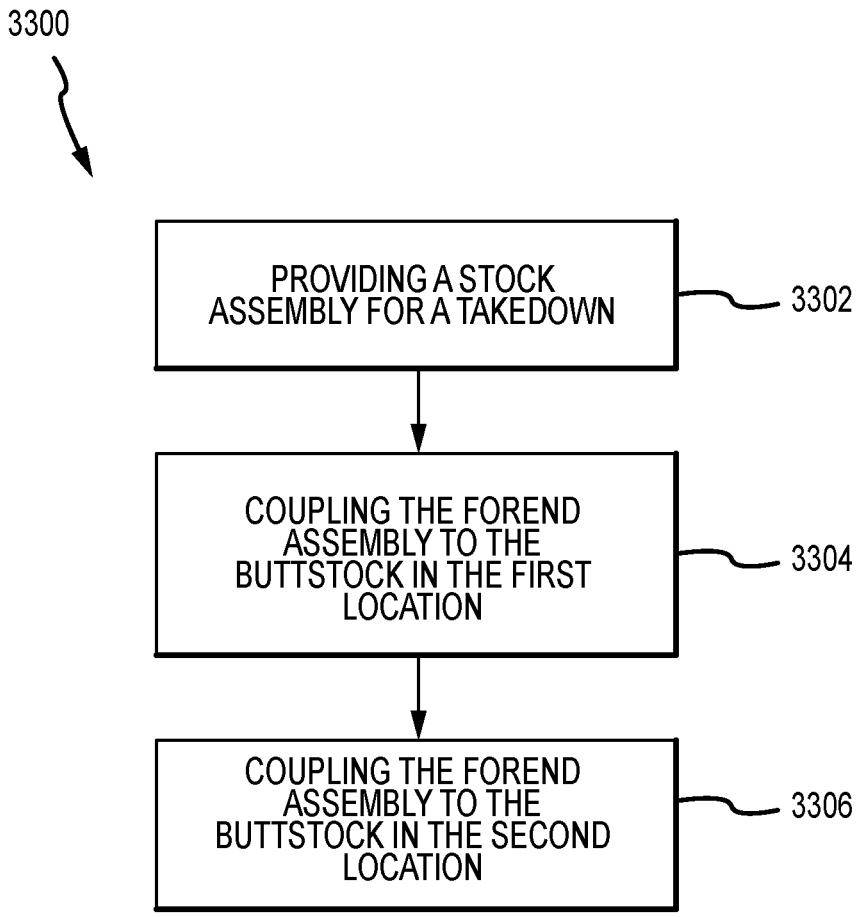
FIG. 33 is a flowchart of a method.

With reference now to FIG. 33, a method 3300 is described. The method 3300 may include providing 3302 a stock assembly for a takedown firearm, the stock assembly having a buttstock assembly, and a forend assembly removably couplable to the buttstock assembly at a first location and a second location. The method 3300 may include coupling 3304 the forend assembly to the buttstock at the first location, wherein the forend assembly is positioned to support a barrel of the firearm in a longitudinal firing position. The method 3300 may include coupling 3306 the forend assembly to the buttstock at the second location, wherein the forend assembly is positioned to support the barrel at an angle relative to the longitudinal firing position.

The method 3300 may include operating a release mechanism to detach the forend from the second location on the buttstock assembly. The method 3300 may include storing a firearm magazine in a vertical orientation in the buttstock assembly. The method 3300 may include nesting the forend assembly in a storage cavity of the buttstock assembly.

The word "exemplary" is used herein to mean "serving as an example, instance, or illustration." Any embodiment described herein as "exemplary" is not necessarily to be construed as preferred or advantageous over other embodiments.

The terms and expressions employed herein are used as terms and expressions of description and not of limitation, and there is no intention, in the use of such terms and expressions, of excluding any equivalents of the features shown and described or portions thereof. In addition, having described certain embodiments, it will be apparent to those of ordinary skill in the art that other embodiments incorporating the concepts disclosed herein may be used without departing from the spirit and scope of the disclosure. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this disclosure is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of an actuator should be understood to encompass disclosure of the act of actuating—whether explicitly discussed or not—and, conversely, were there only disclosure of the act of actuating, such a disclosure should be understood to encompass disclosure of an actuating mechanism. Such changes and alternative terms are to be understood to be explicitly included in the description.

The previous description of the disclosed embodiments and examples is provided to enable any person skilled in the art to make or use the present disclosure as defined by the claims. Thus, the present disclosure is not intended to be limited to the examples disclosed herein. Various modifications to these embodiments will be readily apparent to those skilled in the art, and the generic principles defined herein may be applied to other embodiments without departing from the spirit or scope of the disclosure as claimed.

What is claimed is:

1. A stock assembly for a takedown firearm, the stock assembly comprising:

a buttstock assembly comprising an aperture for removably receiving a barrel shank, the barrel shank configured to couple to a receiver of the takedown firearm; and a forend assembly removably couplable to the buttstock assembly at a first location and a second location; wherein when the forend assembly is coupled to the buttstock assembly at the first location, the forend assembly is positioned to support a barrel of the firearm in a longitudinal firing position;

when the forend assembly is coupled to the buttstock assembly at the second location, the forend assembly is nested in a storage cavity of the buttstock assembly; and when the forend assembly is coupled to the buttstock assembly at the second location, the forend assembly is positioned to support the barrel at an angle relative to the longitudinal firing position.

2. The stock assembly of claim 1, further comprising: a release mechanism for coupling the buttstock assembly and the forend assembly.

3. The stock assembly of claim 2, wherein:

the release mechanism comprises at least one of a detent engagement between the buttstock assembly and the forend assembly or a lever engagement between the buttstock assembly and the forend.

4. The stock assembly of claim 3, wherein:

the release mechanism comprises a button and a detent engagement, the button configured to release the detent engagement when depressed.

5. The stock assembly of claim 3, wherein:

the release mechanism comprises a plurality of buttons and a detent engagement, the buttons configured to release the detent engagement when depressed.

6. The stock assembly of claim 1, wherein:

the forend assembly comprises a recess for receiving a barrel of the firearm; and the buttstock assembly comprises a tang and a recess for providing a clearance for the barrel.

7. The stock assembly of claim 6, wherein:

the tang comprises a tang insert for receiving the barrel.

8. The stock assembly of claim 1, wherein:

the buttstock assembly further comprises a storage compartment, the storage compartment having a detachable cheekpiece forming a top portion of the storage compartment, and a release mechanism for enabling detachment of the cheekpiece.

9. The stock assembly of claim 8, further comprising:

a removable separator wall positioned inside the storage compartment, the separator wall shaped to divide the storage compartment into a plurality of sub-compartments.

10. The stock assembly of claim 8, wherein:

the storage compartment is further shaped and configured to store a firearm magazine in a vertical orientation.

11. The stock assembly of claim 8, wherein:

the release mechanism comprises a detent engagement between the cheekpiece and another wall of the storage compartment.

12. The stock assembly of claim 1, wherein:

the forend assembly is coupled to the buttstock assembly at two or more attachment points when the forend is coupled to the buttstock assembly at the second location.

13. The stock assembly of claim 1, wherein:

the buttstock assembly further comprises a passage for supporting the barrel.

14. A takedown firearm, comprising:

a stock assembly having a buttstock assembly comprising an aperture; and a forend assembly removably couplable to the buttstock assembly at a first location and a second location; wherein when the forend assembly is coupled to the buttstock at the first location, the forend assembly is positioned to support a barrel of the firearm in a longitudinal firing position; and when the forend assembly is coupled to the buttstock at the second location, the forend assembly is positioned to support the barrel at an angle relative to the longitudinal firing position and the forend assembly is nested in a storage cavity of the buttstock assembly; and a barrel removably coupled to the forend and configured for coupling to a receiver of the takedown firearm, the barrel having a barrel shank, the barrel shank configured to engage the aperture in the buttstock assembly when the forend assembly is coupled to the buttstock at the second location.

15. A method, comprising:

providing a stock assembly for a takedown firearm, the stock assembly comprising: a buttstock assembly, and a forend assembly removably couplable to the buttstock assembly at a first location and a second location;

coupling the forend assembly to the buttstock at the first location, wherein the forend assembly is positioned to support a barrel of the firearm in a longitudinal firing position, the takedown firearm having a receiver and a barrel shank of the barrel configured to couple to the receiver; and coupling the forend assembly to the buttstock at the second location, wherein the forend assembly is positioned to support the barrel at an angle relative to the longitudinal firing position, wherein the forend assembly is nested in a storage cavity of the buttstock assembly, and wherein the barrel shank is removably received within an aperture of the buttstock assembly.

16. The method of claim 15, further comprising:

operating a release mechanism detach the forend from the second location on the buttstock assembly.

17. The method of claim 15, further comprising:

storing a firearm magazine in a vertical orientation in the buttstock assembly.

* * * * *